US008651074B2

(12) United States Patent
Urushihata et al.

(10) Patent No.: US 8,651,074 B2
(45) Date of Patent: Feb. 18, 2014

(54) VARIABLE VALVE TIMING DEVICE

(75) Inventors: Haruyuki Urushihata, Chiryu (JP); Minoru Wada, Obu (JP)

(73) Assignee: Denso Corporation, Kariya (JP)

( * ) Notice: Subject to any disclaimer, the term of this patent is extended or adjusted under 35 U.S.C. 154(b) by 901 days.

(21) Appl. No.: 12/828,793

(22) Filed: Jul. 1, 2010

(65) Prior Publication Data

US 2011/0000449 A1 Jan. 6, 2011

(30) Foreign Application Priority Data

Jul. 3, 2009 (JP) ..... 2009-158754

(51) Int. Cl.
*F01L 1/34* (2006.01)

(52) U.S. Cl.
USPC ..... 123/90.17

(58) Field of Classification Search
USPC ..... 123/90.15, 90.17; 464/160, 161
See application file for complete search history.

(56) References Cited

U.S. PATENT DOCUMENTS 6,330,870 B1 * 12/2001 Inoue et al. ..... 123/90.17
6,779,499 B2 * 8/2004 Takenaka et al. ..... 123/90.17
6,837,200 B2 * 1/2005 Ichinosawa ..... 123/90.17
7,565,888 B2 * 7/2009 Sawdon et al. ..... 123/90.17
2002/0139332 A1 10/2002 Takenaka
2006/0236964 A1 * 10/2006 Sawdon et al. ..... 123/90.17

FOREIGN PATENT DOCUMENTS

JP 11-210424 8/1999

OTHER PUBLICATIONS

U.S. Appl. No. 12/852,273, Urushihata, filed Aug. 6, 2010.
U.S. Appl. No. 12/852,283, Urushihata, filed Aug. 6, 2010.
Office Action (3 pages) dated Jan. 22, 2013 issued in corresponding Japanese Application No. 2009-158754 and English translation (4 pages).

* cited by examiner

*Primary Examiner* — Thomas Denion
*Assistant Examiner* — Daniel Bernstein
(74) *Attorney, Agent, or Firm* — Nixon & Vanderhye PC

(57) ABSTRACT

A VVT has a movable restriction member and a restriction slot. When the restriction member is in a projected position, the VVT is variable in a restricted range to which the restriction member can be rotatable within the restriction slot. When the restriction member is in a retracted position, the VVT is variable in a range wider than the restricted range. When a condition where the restriction member shall be projected is satisfied, if the variable range of the VVT reaches beyond the restricted range, the device determines that the restriction member is stuck at the retracted position. When a condition where the restriction member shall be retracted is satisfied, if the variable range of the VVT is restricted in the restricted range, the device determines that the restriction member is stuck at the projected position.

5 Claims, 10 Drawing Sheets

VARIABLE VALVE TIMING DEVICE

CROSS REFERENCE TO RELATED APPLICATION

This application is based on Japanese Patent Application No. 2009-158754 filed on Jul. 3, 2009, the contents of which are incorporated herein by reference in its entirety.

FIELD OF THE INVENTION

The present invention relates to a variable valve timing device which adjusts opening and closing timing of an intake valve or an exhaust valve in an engine.

BACKGROUND OF THE INVENTION

A variable valve timing device (VVT) for adjusting opening and closing timing of an intake valve or an exhaust valve in an engine is known. The VVT is applied to the engine which includes a camshaft for operating the intake valve or the exhaust valve, and an engine output shaft, e.g., a crankshaft, which synchronously rotates the camshaft via a drive train such as a belt drive train and a gear train. The VVT may be installed in the drive train for transmitting driving force from the output shaft to the camshaft. The VVT includes a first rotor which rotates with either one of the camshaft and the output shaft, and a second rotor which rotates with the other one of the camshaft and the output shaft. The VVT may be configured as a displacement type rotary machine which varies relative rotational position of the first and second rotors by controlling operating fluid supplied to chambers. One type of the VVT is known as a vane type machine which includes a housing provided as one of the first and second rotors and a vane rotor provided as the other one. The housing and the vane rotor define at least one pair of an advancing chamber and a retarding chamber. Usually, the vane rotor divides a chamber defined in the housing into the advancing chamber and retarding chamber. The VVT further includes a fluid control devices and a control unit for controlling the fluid control devices to adjust a relative rotational position between the housing and the vane rotor. For example, the control unit controls fluid supply to the chambers and fluid discharge from the chambers.

In such a system, in order to supply sufficiently pressurized operating fluid, such as oil, it is necessary to begin operation of a pump well before starting control of the VVT. For example, in a case that a pump is driven by the output shaft of the engine, it is impossible to supply sufficiently pressurized fluid at an early stage of starting of the engine. Therefore, due to fluctuation torque on the camshaft caused by valve springs and insufficient pressure, the housing and the vane rotor may be adversely rotated and can not maintain a required relative rotational position.

To address the above-mentioned problem, the conventional VVT has a restriction mechanism such as a narrowly restricting lock mechanism which includes a lock pin and a lock slot to be engaged with each other. The lock pin is constructed to be projected to the projected position when a predetermined projecting condition is satisfied. If the lock pin in the projected position meets the lock slot, the lock pin is engaged with the lock slot to lock the housing and the vane rotor to be impossible to rotate relatively. The lock mechanism is operated to lock the housing and the vane rotor before an engine starting event. For example, the lock mechanism locks the rotors at a last stopping event of the engine. As a result, it is possible to keep the relative rotational position of the housing and the vane rotor at a predetermined position suitable for restarting the engine.

During a locking operation of the lock mechanism, the lock pin moves toward the lock slot in a rotating or orbiting manner as the housing and the vane rotor are relatively rotated. In detail, due to the fluctuation torque, the lock pin and lock slot approaches each other while slightly oscillating in an advancing direction and a retarding direction. Therefore, in some cases depending upon oscillating movement, the lock pin and the lock slot may not be able to be engaged before the engine and the pump completely are stopped.

To address the above-mentioned problem, the VVT disclosed in JP2002-357105 includes a guiding mechanism for guiding the lock pin in the projected position to the lock slot by a guide slot. The guide slot is formed to be overlapped with the lock slot. In other words, the lock slot is provided within a rotatable range defined by the lock pin and the guide slot. According to the VVT, the lock pin can be caught by the guide slot, then, is rotated toward the lock slot while rotatable range of the lock pin is restricted by the guide slot. Therefore, since the lock pin is rotated toward the lock slot under restricted state, it is possible to facilitate an engagement of the lock pin and the lock slot.

SUMMARY OF THE INVENTION

However, since the lock pin is moved between the projected position and the retracted position, the lock pin may be failed by sticking in a bore, such as in a projected stuck failure and a retracted stuck failure. Therefore, in order to improve reliability, it is required to determine such stuck failure.

It is an object of the present invention to provide a VVT which is capable of determining stuck failure of a movable restricting member for restricting relative rotational range of rotors.

It is another object of the present invention to provide a VVT which is capable of determining stuck failure of a pin for locking rotors.

According to an embodiment of the present invention, a stuck determination unit determines that whether a restricting condition or an enabling condition is satisfied or not. Further, the stuck determination unit determines that a restriction member is stuck in an abnormal state when the restricting condition or the enabling condition is satisfied and a restriction mechanism does not provide a restricted state or an enabled state corresponding to the satisfied condition.

For example, the stuck determination unit may include a lock-pin-retracted-stuck-determination unit which determines that the lock pin is stuck in the retracted position when the lock-pin-projecting condition is satisfied and the relative rotation of the rotors is changed from an inside to an outside of the restricted range.

For example, the stuck determination unit may include a lock-pin-projected-stuck-determination unit which determines that the lock pin is stuck in the projected position when the lock-pin-retracting condition is satisfied and the relative rotation of the rotors can not be changed from an inside to an outside of the restricted range.

For example, the stuck determination unit may include a restriction-pin-projected-stuck-determination unit which determines that a restriction pin is stuck in the projected position when a restriction-pin-retracting condition is satisfied and the relative rotation of the rotors can not be changed from an inside to an outside of an additional restricted range.

For example, the stuck determination unit may include a restriction-pin-retracted-stuck-determination unit which determines that the restriction pin is stuck in the retracted position when the restriction-pin-projecting condition is satisfied and the relative rotation of the rotors is changed from an inside to an outside of the additional restricted range.

For example, the stuck determination unit may include a restriction-pin-retracted-stuck-determination unit which determines that at least one of a first and second restriction pins is stuck in the retracted position when a restriction-pin-projecting condition is satisfied and the relative rotation of the rotors is changed from an inside to an outside of a consolidated range which includes both a first and second restricted ranges provided by the first and second restriction pins respectively.

For example, the stuck determination unit may include a restriction-pin-projected-stuck-determination unit which determines that at least one of the first and second restriction pins is stuck in the projected position when the restriction-pin-retracting condition is satisfied and the relative rotation of the rotors can not be changed from the inside to the outside of the consolidated range.

BRIEF DESCRIPTION OF THE DRAWINGS

Additional objects and advantages of the present invention will be more readily apparent from the following detailed description of preferred embodiments when taken together with the accompanying drawings. In which.

DETAILED DESCRIPTION OF THE PREFERRED EMBODIMENTS

Hereinafter, embodiments of the present invention are described in detail referring to the attached drawings. In the following description and drawings, the same reference number or symbol is given to a component or part which is the same or similar to one that already described in the preceding embodiments. The preceding description may be referenced for the component or part denoted by the same reference number or symbol. Hereinafter, differences from the preceding embodiments are mainly explained in each embodiment. Other configurations are similar to or the same as that of the preceding embodiments, therefore, unless it is apparent, it is possible to achieve similar or the same functions and advantages as described in the preceding embodiments.

First Embodiment

Figure 1:
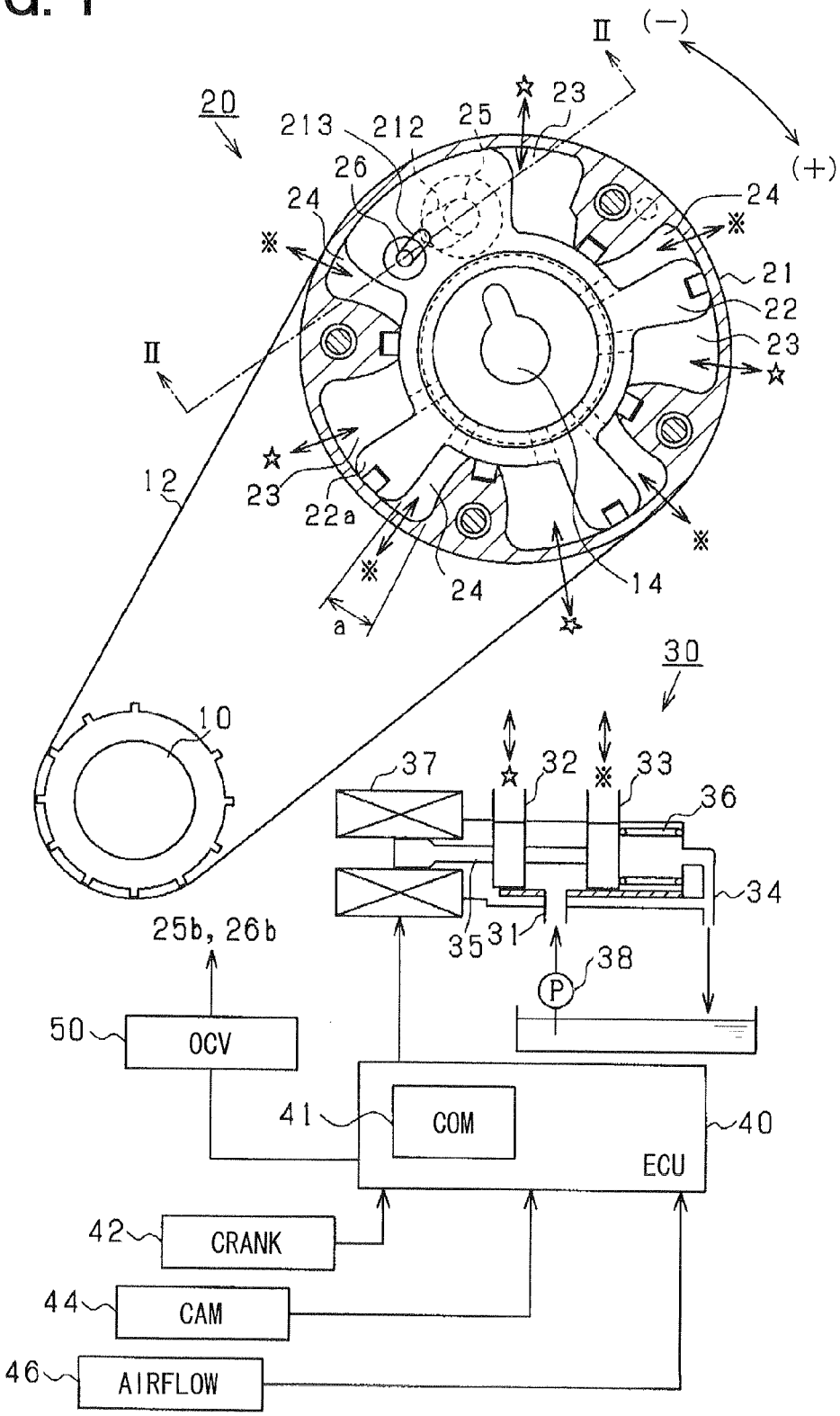
FIG. 1 is a block diagram showing a variable valve timing device according to a first embodiment of the present invention.

FIG. 1 is a block diagram showing a variable valve timing device according to a first embodiment of the present invention.

As shown in the drawings, a variable valve timing device (VVT) 20 is disposed in a drive train for transmitting valve driving force from a crankshaft (output shaft) 10 to a camshaft 14 of an engine. The drive train is provided by a belt drive mechanism including a belt 12 and pulleys. The VVT 20 is provided with a first rotor (housing) 21 which is mechanically connected with the crankshaft 10, and a second rotor (vane rotor) 22 which is mechanically connected with the camshaft 14. The second rotor 22 is provided with a plurality of radially protruded portions (vanes) 22*a*, and is rotatably housed in an inner chamber defined in the first rotor 21. The VVT 20 includes a plurality of pairs of a retarding chamber 23 and an advancing chamber 24. The retarding chamber 23 retards (−) the relative rotational position when the retarding chamber 23 increases the volume. The advancing chamber 24 advances (+) the relative rotational position when the advancing chamber 24 increases the volume. The relative rotational position between the first rotor 21 and the second rotor 22 may be also referred to as a relative rotational phase or a relative rotational angle. The retarding chambers 23 and the advancing chambers 24 are defined between the first rotor 21 and the second rotor 22. In other words, the chamber defined in the first rotor 21 is divided into the retarding chamber 23 and the advancing chamber 24 placed on rotational sides of the vane 22*a* respectively. Therefore, a rotating mechanism for relatively rotating the rotors 21 and 22 by using pressure of operating fluid, e.g., oil, is constructed between the first rotor 21 and the second rotor 22. The rotating mechanism is a displacement type rotary machine including a plurality of hydraulic actuators. In addition, the rotating mechanism include a hydraulic pressure supply device such as a pump, conduits and a flow control device such as a control valve mentioned later.

The VVT 20 includes a restriction mechanism. The restriction mechanism selectively provides a restricted state in which relative rotation of the rotors 21 and 22 is restricted in a predetermined restricted range and an enabled state in which relative rotation of the rotors 21 and 22 is enabled to outside of the restricted range. The restriction mechanism includes a movable restriction member which is moved to a restricting position to provide the restricted state when a predetermined restricting condition is satisfied, and is moved to an enabling position to provide the enabled state when a predetermined enabling condition is satisfied. In this embodiment, the restriction mechanism can provide a plurality of restricted states including a narrow restricted state, a middle restricted state, and a wide restricted state. The narrow restricted state may be referred to as a lock state in which the rotors 21 and 22 are locked to be impossible to rotate each other. The middle restricted state may be referred to as a guide state or a first restricted state in which the rotors 21 and 22 are enabled to rotate each other only within a first restricted range which is wider than a rotatable range in the lock state. The first restricted range is defined to include a lock position where the lock state is provided. Therefore, in the first restricted state, it is possible to facilitate an engagement of the restriction member to provide the lock state. The wide restricted state may be referred to as a second restricted state in which the rotors 21 and 22 are enabled to rotate each other only within a second restricted range. The second restricted range is wider than the first restricted range and is narrower than a maximum rotatable range. The lock mechanism may be referred to as a restriction mechanism which can provide a plurality of restricting stages. Alternatively, the restriction mechanism may be understood as a compound including a lock mechanism which locks the rotors and a restriction mechanism which still enables the rotors to rotate within a restricted range. The restriction mechanism may be referred to as a lock mechanism. The VVT 20 includes the restriction mechanism which locks the rotors 21 and 22 to be impossible to rotate at the lock position. The lock position is located in an intermediate position between a most retarded position MRTD and the most advanced position MADV. In the most retarded position MRTD, the retarding chamber 23 becomes maximum volume. In the most advanced position MADV, the advancing chamber 24 becomes maximum volume. The lock mechanism will be explained in detail.

The VVT 20 is a hydraulic actuator in which a hydraulic drive is carried out by controlling oil flow with respect to the retarding chamber 23 and the advancing chamber 24. Oil flow is controlled by an oil control valve (OCV) 30.

The OCV 30 supplies the oil supplied through a supply conduit 31 from a pump 38 to the retarding chamber 23 or the advancing chamber 24 through a retarding conduit 32 or an advancing conduit 33. The OCV 30 drains the oil discharged from the retarding chamber 23 or the advancing chamber 24 through the retarding conduit 32 or the advancing conduit 33 through a drain conduit 34 to an oil reservoir.

The OCV 30 includes a spool 35. In the drawing, the spool 35 is always urged toward the left by a spring 36 and is applied with operating force toward the right by an electromagnetic solenoid 37. A displacement of the spool 35 can be controlled by adjusting an amount of current flowing through the electromagnetic solenoid 37 by adjusting duty value of control signal supplied to the electromagnetic solenoid 37. As a result, communication and communicating passage area among the conduits 31, 32, 33, and 34 can be controlled by the spool 35.

For example, if the spool 35 is displaced to the left from the illustrated position, the oil is supplied from the pump 38 to the retarding chamber 23 through the conduits 31 and 32. At the same time, the oil is discharged from the advancing chamber 24 to the oil reservoir through the conduits 33 and 34. Thereby, the second rotor 22 is relatively rotated in the counter clockwise direction with respect to the first rotor 21. This rotating direction is a retarding direction.

On the other hand, if the spool 35 is displaced to the right from the illustrated position, the oil is supplied from the pump 38 to the advancing chamber 24 through the conduits 31 and 33. At the same time, the oil is discharged from the retarding chamber 23 to the oil reservoir through the conduits 32 and 34. Thereby, the second rotor 22 is relatively rotated in the clockwise direction with respect to the first rotor 21. This rotating direction is an advancing direction.

When both the conduits 32 and 33 are closed by the spool 35 placed in the illustrated position, since oil flow is stopped for both the retarding chamber 23 and the advancing chamber 24, a relative rotational position is maintained.

An electronic control unit (ECU) 40 is provided as a controller for adjusting the duty of the control signal for the electromagnetic solenoid 37. The ECU 40 includes a microcomputer (COM) 41 provided as a main component and some peripheral components. The ECU 40 and the COM 41 executes program to input detected signals indicative of various operating states of the engine and to control actuators such as the OCV 30 in order to control the VVT 20 and the engine. For sensing the operating condition of the engine, the system includes sensors such as a crank angle sensor 42, a cam angle sensor 44, and an airflow meter 46. The crank angle sensor 42 detects a rotational angle of a crankshaft 10. The cam angle sensor 44 detects a rotational angle of the camshaft 14. The airflow meter 46 detects an intake air volume.

For example, the ECU 40 calculates an engine speed NE based on the detected value of the crank angle sensor 42. The ECU 40 calculates a suction amount (engine load) based on the detected value of the airflow meter 46. The ECU 40 calculates an actual position (actual relative rotational phase) AC based on the detected value of the crank angle sensor 42 and the cam angle sensor 44. The ECU 40 further calculates a target position TG based on the operating states of the engine, such as the engine speed NE, and the engine load. For example, if the engine is operated in high load and high NE state, the ECU 40 calculates the target position TG to increase an amount of overlapping in which both the intake valve and the exhaust valve open simultaneously, in order to increase an output power of the engine. On the other hand, if the engine is operated in low load and low NE state, the ECU 40 calculates the target position TG to decrease the amount of overlapping in order to stabilize combustion. The ECU 40 performs a feedback control on the OCV 30 to approach a difference between the actual position AC and the target position TG to zero.

The duty of the control signal supplied to the electromagnetic solenoid 37 is adjusted by the ECU 40 to adjust the actual position AC to the target position TG. In other words, the ECU 40 adjusts a relative rotational position of the VVT 20 and a relative rotational phase between the camshaft 14 and the crankshaft 10. As a result, the opening and closing timing of the intake valve or the exhaust valve of the engine is adjusted to adjust the amount of overlapping. In this embodiment, the VVT 20 is only mounted on the camshaft 14 for driving the intake valve. No VVT is mounted on a camshaft for driving the exhaust valve in the embodiment. Alternatively, however, the VVT may be mounted on the camshaft for driving the exhaust valve. The VVT may be mounted on at least one camshaft for driving the intake valve or the exhaust valve.

Figure 2:
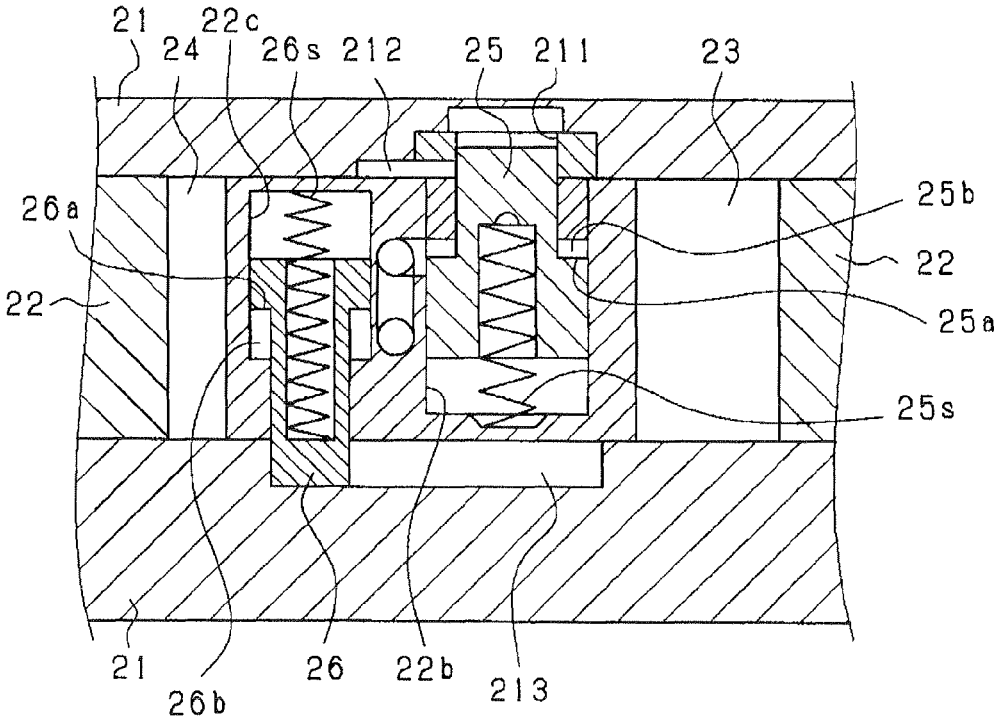
FIG. 2 is a sectional view showing a cross section along a line II-II in FIG. 1.

FIG. 2 is a sectional view showing a cross section along a line II-II in FIG. 1. The structure of the restriction mechanism (lock mechanism) can be understood based on FIG. 1 and FIG. 2.

The restriction mechanism selectively provides the restricted state in which relative rotation of the rotors is restricted in a predetermined restricted range, and the enabled state in which relative rotation of the rotors is enabled to the outside of the restricted range. The restricted state may correspond to a lock state in which the rotors can not be rotated. In this case, the enabled state corresponds to a free state in which the rotors can be rotated without any restriction or another restricted state in which the rotors can be rotated in a range wider than the lock state. On the other hand, the restricted state may correspond to a first restricted state in which the rotors can be rotated within a predetermined restricted range. In this case, the enabled state corresponds to the free state or another restricted state in which the rotors can be rotated in a range wider than the first restricted state. The restriction mechanism is provided with the restriction member which provides the restricted state by moving to a restricting position when predetermined restricting condition is satisfied, and which provides the enabled state by moving to an enabling position when predetermined enabling condition is satisfied.

In this embodiment, the lock mechanism is mainly constructed by a lock pin 25, a lock slot 211, a guide slot 212, a restriction pin 26, and a restriction slot 213 which are explained below.

The lock pin 25 is a first restriction member. The lock slot 211 is a narrower one of a first restriction slot. The guide slot 212 is a wider one of the first restriction slot. The restriction pin 26 is a second restriction member. The restriction slot 213 is a second restriction slot.

The lock pin 25 is movably supported in a holding hole 22*b* formed in the second rotor 22. The lock pin 25 can move in an axial direction of the VVT 20 between a retracted position and a projected position. Since the lock pin 25 is supported on the second rotor, as the second rotor 22 rotates with respect to the first rotor 21, the lock pin 25 is also rotated along an orbital path in a circumferential direction of the VVT 20. FIG. 2 shows the VVT 20 when the lock pin 25 is projected from the holding hole 22*b*. The holding hole 22*b* is provided with a spring 25*s* which elastically urges the lock pin 25 in a projecting direction.

The second rotor 22 and the lock pin 25 define a control chamber 25*b*. The lock pin 25 is formed with a pressure receiving surface 25*a* which is located to thrust the lock pin 25 toward the retracted position, i.e., in an anti-projecting direction, by the oil introduced in the control chamber 25*b*. A part of the oil pressurized by the pump 38 is introduced into the control chamber 25*b*. Therefore, in order to increase the pressure of the oil in the control chamber 25*b* to a certain level sufficient to move the lock pin 25, it is necessary to elapse a predetermined time from beginning of operation of the pump 38 by starting the engine. If pressure of supplied oil in the control chamber 25*b* is increased to generate a thrust force which exceeds a thrust force generated by the spring 25*s*, the lock pin 25 is moved from the projected position to the retracted position where the lock pin 25 is entirely retracted into the holding hole 22*b*. On the other hand, if the pressure of supplied oil in the control chamber 25*b* is decreased, clue to stopping of the engine, to a certain level which generates a thrust force lower than the thrust force generated by the spring 25*s*, the lock pin 25 is moved from the retracted position to the projected position by the spring 25*s*.

The system further includes an oil control valve (OCV) 50 which can be operated by the ECU 40 independently from the OCV 30. The OCV 50 independently controls oil flow supplied to and discharged from the control chamber 25*b*. That is, the oil in the control chamber 25*b* is controlled independently from the oil in the retarding chamber 23 and the advancing chamber 24. The OCV 30 shown in FIG. 1 may be replaced with an alternative OCV which further includes a part capable of functioning as the OCV 50. For example, the alternative OCV may include both an inlet port and an outlet port for the control chamber 25*b*. In such an alternative arrangement, it is possible to control supply flow and discharge flow of the oil with respect to the control chamber 25*b*, the retarding chamber 23 and the advancing chamber 24 by using one OCV.

The lock slot 211 is formed on the first rotor 21 at a position to which a distal end of the lock pin 25 in the lock position is opposed. The lock slot 211 is formed to be engaged with the distal end of the lock pin 25 when the lock pin 25 is moved to the lock position by rotating the rotors 21 and 22. The lock pin 25 and the lock slot 211 locks the rotors 21 and 22 to be impossible to rotate relatively during the lock pin 25 and the lock slot 211 are engaged.

Figure 4:
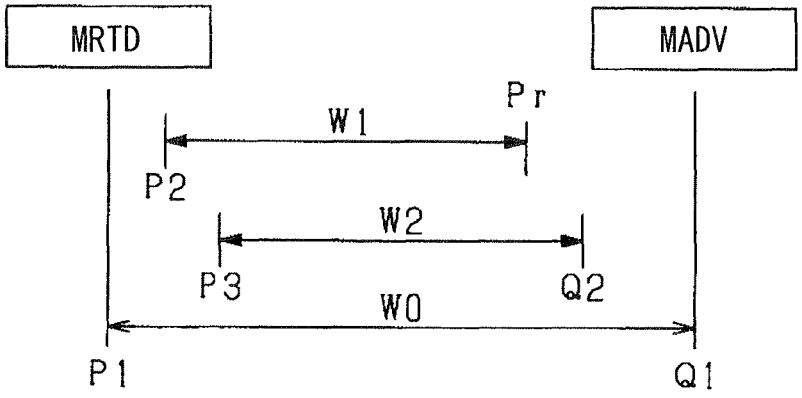
FIG. 4 is a graph showing a restricted range (first range) and additional restricted range (second range) in the first embodiment.

When stopping an engine, the ECU 40 performs a lock control in which the target position TG is adjusted to rotate the VVT 20 to the lock position in order to engage the lock pin 25 and the lock slot 211. By performing the lock control, it is possible to provide the lock state at a subsequent starting of the engine. In a period just after a starting of the engine, pressure of the oil in the retarding chamber 23 and the advancing chamber 24 is not increased sufficiently. However, according to the lock mechanism, it is possible to maintain the VVT 20 at the lock position to avoid fluctuating. As shown in FIG. 4, the lock position Pr is set in an intermediate position of the maximum rotatable range W0.

The guide slot 212 is formed on the first rotor 21. The guide slot 212 is formed to be engaged with the distal end of the lock pin 25 in the projected position. The guide slot 212 is formed in an arc shape to enable the lock pin 25 to be rotatable within a predetermined rotational angular range. Therefore, if the lock pin 25 and the guide slot 212 are engaged, the rotatable range of the lock pin 25, i.e., the relative rotatable range between the first rotor 21 and the second rotor 22, is restricted to the first restricted range W1.

The lock slot 211 is formed on a bottom of the guide slot 212 at a most advanced position which is the lock position Pr. As shown in FIG. 2, depth of the lock slot 211 is formed deeper than depth of the guide slot 212. The lock pin 25 engaged with the guide slot 212 can be projected to a first stage of the projected position. Then, in a case that the lock pin 25 is rotated to the lock position Pr, the lock pin 25 can be projected to a second stage of the projected position and is engaged with the lock slot 211. Therefore, the lock pin 25 projects in a two step manner in the lock control. The guide slot 212 can catch the lock pin 25 in a range wider than the lock position. Therefore, the guide slot 212 can guide the lock pin 25 to the lock slot 211 and facilitates an engagement of the lock pin 25 and the lock slot 211 when the lock pin 25 is driven in the projecting direction.

The restriction pin 26 is movably supported in a holding hole 22*c* formed in the second rotor 22. The restriction pin 26 can move between a retracted position and a projected position. FIG. 2 shows condition when the restriction pin 26 is projected from the holding hole 22*c*. The holding hole 22*c* is provided with a spring 25*s* which elastically urges the restriction pin 26 in a projecting direction. The restriction pin 26 projects from the second rotor 22 in a direction opposite to a projecting direction of the lock pin 25.

The second rotor 22 and the restriction pin 26 define a control chamber 26*b*. The restriction pin 26 is formed with a pressure receiving surface 26*a* which is located to thrust the restriction pin 26 toward the retracted position, i.e., in an anti-projecting direction, by the oil introduced in the control chamber 26*b*. A part of the oil pressurized by the pump 38 is introduced into the control chamber 26*b*. Therefore, in order to increase the pressure of the oil in the control chamber 26*b* to a certain level sufficient to move the restriction pin 26, it is necessary to elapse a predetermined time from beginning of operation of the pump 38 by starting the engine. If pressure of supplied oil in the control chamber 26*b* is increased to generate a thrust force which exceeds a thrust force generated by the spring 26*s*, the restriction pin 26 is moved from the projected position to the retracted position where the restriction pin 26 is entirely retracted into the holding hole 22*c*. On the other hand, if the pressure of supplied oil in the control chamber 26*b* is decreased, due to stopping of the engine, to a certain level which generates a thrust force lower than the thrust force generated by the spring 26*s*, the restriction pin 26 is moved from the retracted position to the projected position by the spring 26*s*.

The control chamber 26*b* for the restriction pin 26 and the control chamber 25*b* for the lock pin 25 are directly communicated to introduce the oil. A condition where the lock pin 25 shall be projected is one of the restricting condition and includes a condition where the pressure of the supplied oil is lower than the predetermined value. A condition where the restriction pin 26 shall be projected is one of the restricting condition and includes a condition where the pressure of the supplied oil is lower than the predetermined value. The restricting condition for the lock pin 25 and the restricting condition for the restriction pin 26 are the same. A condition where the lock pin 25 shall be retracted is one of the enabling condition and includes a condition where the pressure of the supplied oil is equal to or higher than a predetermined value and a condition where the OCV is properly functioning to supply the oil to the control chamber 25*b*. A condition where the restriction pin 26 shall be retracted is one of the enabling condition and includes a condition where the pressure of the supplied oil is equal to or higher than a predetermined value and a condition where the OCV is properly functioning to supply the oil to the control chamber 26*b*. Since the control chambers 25*b* and 26*b* are connected, the enabling condition for the lock pin 25 and the enabling condition for the restriction pin 26 are the same.

The oil pressure may be directly detected by a pressure sensor disposed on a discharge passage of the pump 38. Alternatively, the oil pressure may be estimated based on engine operating state which has certain relationship with the oil pressure. The oil pressure may be substituted by the engine operating state indicative of the oil pressure. For example, the oil pressure may be estimated or calculated based on at least one of the rotating speed of the output shaft, the engine load, and an elapsed time from starting an engine.

The restriction slot 213 is formed on the first rotor 21. The restriction slot 213 is formed to be engaged with the distal end of the restriction pin 26 in the projected position. The restriction slot 213 is formed in an arc shape to enable the restriction pin 26 to be rotatable within a predetermined rotational angular range. Therefore, if the restriction pin 26 and the restriction slot 213 are engaged, the rotatable range of the restriction pin 26, i.e., the relative rotatable range between the first rotor 21 and the second rotor 22, is restricted to the second restricted range W2. The second restricted range W2 is different from the first restricted range W1. The second restricted range W2 is set to include the lock position Pr. The second restricted range W2 is set to overlap with at least a part of the first restricted range. At least one of a retard end P3 and an advance end Q2 of the second restricted range W2 is set to extend at least one of a retard end P2 and an advance end Pr of the first restricted range W1. The first and second restricted ranges provide a consolidated range which is still narrower than the maximum rotatable range W0. The lock position Pr is set in an intermediate position within the consolidated range.

Functions of the guide slot 212 and the restriction slot 213 are explained below.

In a case that the lock control is initiated by the ECU 40, in order to engage the lock pin 25 and the lock slot 211, the lock pin 25 is moved in the projecting direction and is rotated toward the lock position Pr. The camshaft 14 receives the fluctuation torque from components such as valve springs. Therefore, the lock pin 25 is gradually rotated in an oscillating or rocking manner in the retarding and advancing directions. Therefore, in some cases depending upon oscillation, the lock pin 25 and the lock slot 211 may not be able to be engaged before the engine and the pump completely are stopped.

However, the embodiment includes the guide slot 212 and the restriction slot 213 which restrict the relative rotatable range. Therefore, when the lock pin 25 is projected, at least one of the lock pin 25 and the restriction pin 26 is engaged with corresponding slot and restricts the relative rotatable range to the first or the second restricted range. Therefore, the lock pin 25 in the projected position is rotated toward the lock position Pr while restricting the fluctuation. Therefore, both the guide slot 212 and the restriction slot 213 facilitate an engagement of the lock pin 25 and the lock slot 211. It is possible to easily and surely engage the lock pin 25 and the lock slot 211 and to reduce the risk of non-engagement of the lock pin 25 before an engine restart.

Figure 3:
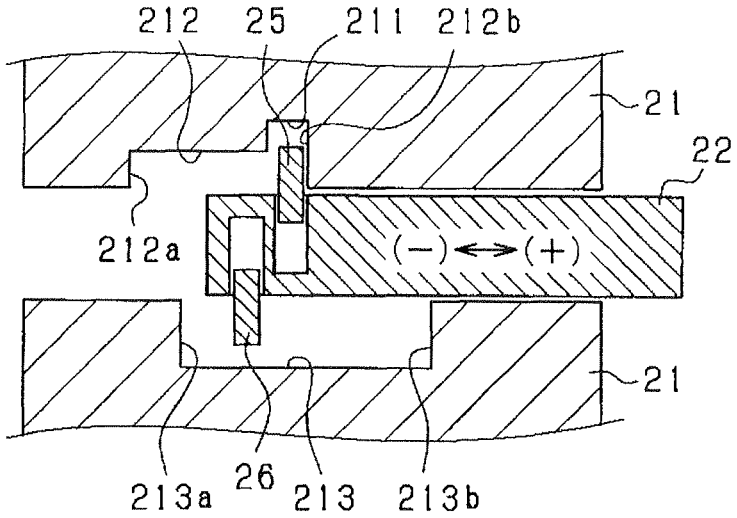
FIG. 3 is a schematic sectional view showing a lock pin and a lock slot (first slot) in the first embodiment.
Figure 5:
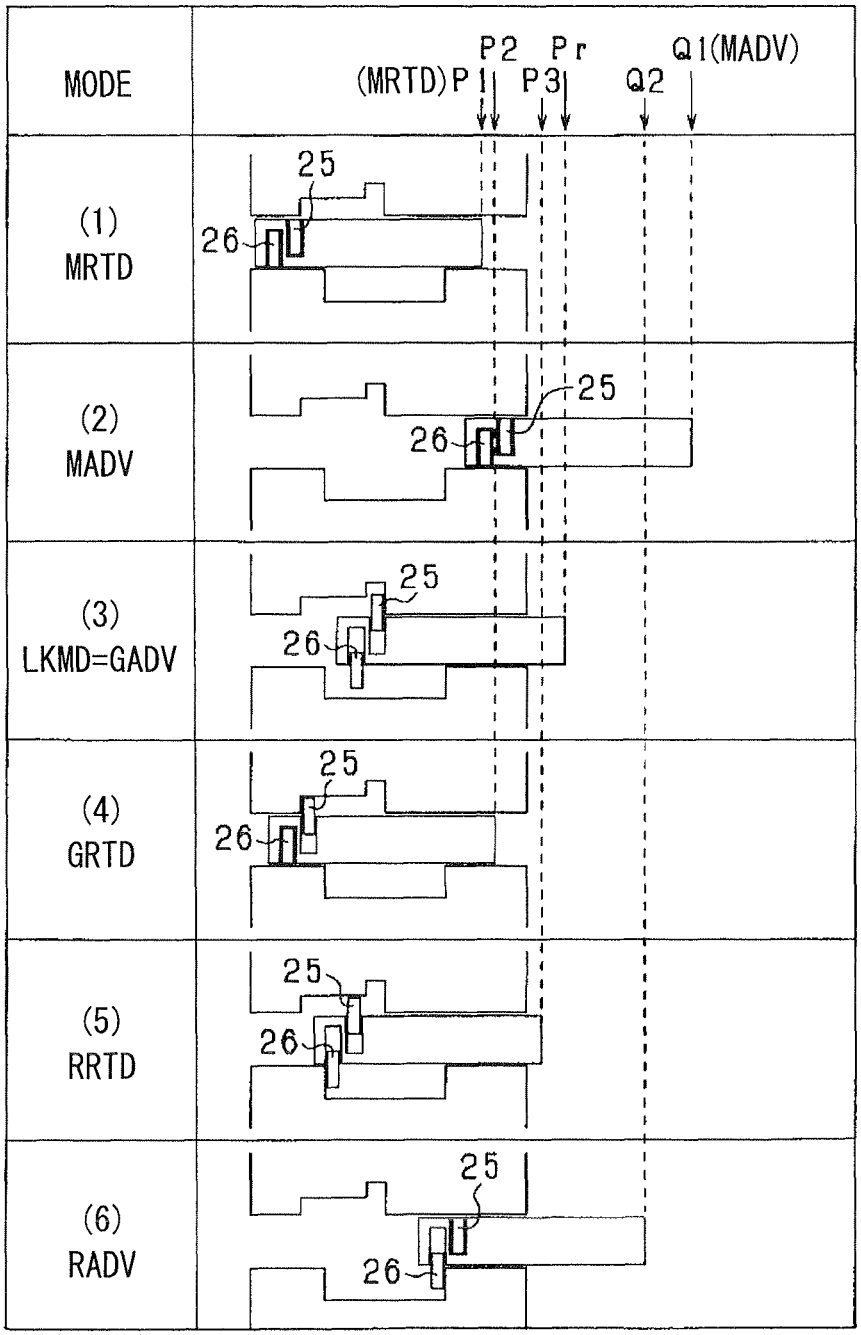
FIG. 5 is a table showing relationships between the lock pin and the lock slot in each mode in the first embodiment.

Referring to FIGS. 3-5, the restriction mechanism is explained in detail. FIG. 3 shows the restriction mechanism in an engaged stage where the lock pin 25 and the lock slot 211 are engaged with each other FIG. 4 shows rotatable ranges of the VVT 20. W0 is a maximum rotatable range when the pins 25 and 26 are in the retracted position. W1 is a first restricted range provided by the lock pin 25 and the guide slot 212. W2 is a second restricted range provided by the restriction pin 26 and the restriction slot 213. FIG. 5 shows a plurality of operation modes of the VVT 20. The modes (1)-(6) can be provided by operating the restriction mechanism as shown in corresponding box.

First, operations of the VVT 20 when a condition where both the pins 25 and 26 should be retracted, e.g., a condition where the pressure of the supplied oil is equal to or higher than a predetermined value, is satisfied are explained. As shown in the mode (1) and mode (2), when both the pins 25 and 26 are in the retracted position, the relative rotational position can be freely varied over the maximum rotatable range W0 from the most retarded position (MRTD) P1 to the most advanced position (MADV) Q1. Therefore, the ECU 40 can set the target position TG within the maximum rotatable range W0. In the drawing, the mode (1) illustrates arrangement of the components of the VVT 20 in the most retarded position MRTD. The mode (2) illustrates arrangement of the components of the VVT 20 in the most advanced position MADV.

Next, operations of the VVT 20 when a condition where both the pins 25 and 26 should be projected, e.g., a condition where the pressure of the supplied oil is lower than a predetermined value, is satisfied and the lock control is executed are explained. In this embodiment, it is expected to bring the lock pin 25 and the lock slot 211 into the lock state by moving the lock pin 25 in the advancing direction from a region more retarded than the lock slot 211. In the lock control, the lock pin 25 is expected to be first engaged with the guide slot 212. The lock pin 25 is further rotated in the advancing direction. Then, the lock pin 25 comes in contact with the advance-side wall 212*b* of the guide slot 212. Since, the lock slot 211 is formed to share the advance-side wall 212*b*, the lock pin 25 further projects to be engaged with the lock slot 211.

In a case that the lock pin 25 is located in a region more retarded than the retard-side wail 212*a* of the guide slot 212, the lock pin 25 is rotated in the advancing direction. Then, the lock pin 25 reaches to a position where the lock pin 25 can be engaged with the guide slot 212. This state is illustrated in the mode (4). Although the lock pin 25 tends to be rocked also in the retarding direction due to the fluctuation torque, the lock pin 25 is restricted from moving in the retarding direction since a side surface of the lock pin 25 comes in contact with the retard-side wall 212*a* of the guide slot 212. That is, the relative rotational position of the VVT 20 is restricted so as not to be rotated in the retarding direction beyond the position P2 defined by the retard-side wall 212*a*. The mode (4) shows a restricted state GRTD provided by a retard-side end of the guide slot 212.

As the lock pin 25 is further rotated in the advancing direction, the restriction pin 26 reaches to a position where the restriction pin 26 can be engaged with the restriction slot 213 and is engaged with the restriction slot 213. Although the restriction pin 26 tends to be rocked also in the retarding direction due to the fluctuation torque, the restriction pin 26 is restricted from moving in the retarding direction since a side surface of the restriction pin 26 comes in contact with the retard-side wall 213*a* of the restriction slot 213. That is, the relative rotational position of the VVT 20 is restricted so as not to be rotated in the retarding direction beyond the position P3 defined by the retard-side wall 213*a*. The mode (5) shows a restricted state RRTD provided by a retard-side end of the restriction slot 213.

As the lock pin 25 is further rotated in the advancing direction, the side surface of the lock pin 25 comes in contact with the advance-side wall 212*b*, and the lock pin 25 is engaged with the lock slot 211. This lock state is illustrated in the mode (3). The mode (3) shows a restricted state GADV provided by an advance-side end of the guide slot 212. The mode (3) also shows the lock state LKMD. As explained above, either the guide slot 212 or the restriction slot 213 provides a guide mechanism which restricts rotatable range of the lock pin 25 to guide the lock pin 25 to the lock position Pr. In addition, the guide slot 212 and the restriction slot 213 provides a step-by-step guide mechanism which narrows rotatable range of the lock pin 25 in a step-by-step manner to guide the lock pin 25 to the lock position Pr.

In a case that the lock pin 25 is located in a region more advanced than the advance-side wall 212*b* of the guide slot 212, the lock pin 25 is rotated in the retarding direction. Then, the restriction pin 26 reaches to a position where the restriction pin 26 can be engaged with the restriction slot 213 and is engaged with the restriction slot 213. This state is illustrated in the mode (6). Although the restriction pin 26 tends to be rocked also in the advancing direction due to the fluctuation torque, the restriction pin 26 is restricted from moving in the advancing direction since a side surface of the restriction pin 26 comes in contact with the advance-side wall 213*b* of the restriction slot 213. That is, the relative rotational position of the VVT 20 is restricted so as not to be rotated in the advancing direction beyond the position Q2 defined by the advance-side wall 213*b*. The mode (6) shows a restricted state RADV provided by an advance-side end of the restriction slot 213.

As the lock pin 25 is further rotated in the retarding direction, since the lock pin 25 is suddenly placed above the lock slot 211, the lock pin 25 may pass the lock slot 211. However, the VVT 20 always rocks also in the advancing direction due to the fluctuation torque. Therefore, the lock pin 25 is rotated in the advancing direction at least a small amount. As a result, the side surface of the lock pin 25 can come in contact with the advance-side wall 212*b*, and the lock pin 25 is engaged with the lock slot 211.

As shown in FIG. 4, the position Q2 defined by the advance-side wall 213*b* of the restriction slot 213 is located in a position more advanced than the lock position Pr. In addition, the position P3 defined by the retard-side wall 213*a* of the restriction slot 213 is located in a position more advanced than the position P2 of the retard-side wall 212*a* of the guide slot 212. Therefore, at least one of the guide slot 212 and the restriction slot 213 provides an engaged state before the lock pin 25 is engaged with the lock slot 211. In other words, either the guide slot 212 or the restriction slot 213 can work as a pre-lock restriction mechanism which restricts a rotatable range of the VVT 20 to facilitate an engagement of the lock mechanism provided by the lock pin 25 and the lock slot 211. The pre-lock restriction mechanism is provided by the lock pin 25, the guide slot 212, the restriction pin 26 and the restriction slot 213. The position P3 may be located on a region more retarded than the position P2.

Both or one of the pins 25 and 26 may be stuck in the projected position or the retracted position. For example, foreign substance contained in the oil may be supplied to the control chambers 25*b* and 26*b* and causes stuck failure.

The foreign substance may enter a gap between the lock pin 25 and the holding hole 22*b*. If the lock pin 25 becomes a projected-stuck failure in which the lock pin 25 is stuck in the projected position, the rotatable range of the VVT 20 is restricted within the first restricted range W1 despite satisfying a retracting condition. If the lock pin 25 becomes a retracted-stuck failure in which the lock pin 25 is stuck in the retracted position, the rotatable range of the VVT 20 can not be restricted within the first restricted range W1 despite satisfying a projecting condition. Further, it is impossible to lock the VVT 20 at the lock position. Even if the lock pin 25 becomes the retracted-stuck failure, the restriction pin 26 and the restriction slot 213 can restrict the relative rotatable range of the VVT 20 within the restricted range W2 which includes the lock position Pr and is narrower than the maximum rotatable range W0.

The foreign substance may enter a gap between the restriction pin 26 and the holding hole 22*c*. If the restriction pin 26 becomes a projected-stuck failure in which the restriction pin 26 is stuck in the projected position, the rotatable range of the VVT 20 is restricted within the second restricted range W2 despite satisfying a retracting condition. Even if the restriction pin 26 becomes the projected-stuck failure, the lock pin 25 and the guide slot 212 can further restrict the relative rotatable range of the VVT 20 and the lock pin 25 and the lock slot 211 can lock the VVT 20. If the restriction pin 26 becomes a retracted-stuck failure in which the restriction pin 26 is stuck in the retracted position, the rotatable range of the VVT 20 can not be restricted within the second restricted range W2 despite satisfying a projecting condition. Even if the restriction pin 26 becomes the retracted-stuck failure, the lock pin 25 and the guide slot 212 can restrict the relative rotatable range of the VVT 20 within the restricted range W1 and the lock pin 25 and the lock slot 211 can lock the VVT 20. If both the pins 25 and 26 are stuck in the projected-stuck positions, the rotatable range of the VVT 20 is adversely restricted within a range between the position P3 and the position Pr or in the lock position Pr. If both the pins 25 and 26 are stuck in the retracted-stuck positions, the rotatable range of the VVT 20 can not be restricted and locked.

In the embodiment, the ECU 40 is configured to work as a stuck determination unit which determines that whether the restriction member is stuck in abnormal states or not. In detail, the COM 41 performs programs shown in the flow charts in FIGS. 6-14 to make the ECU 40 functions as the stuck determination unit. The unit may be called as a component or module for performing corresponding process. The ECU 40 includes storage medium which can be read by a computer The storage medium stores the program corresponding to the flow charts in FIGS. 6-14 which can be read and performed by the COM 41. The storage medium may be provided by a memory. When the program is executed by the COM 41, the program causes the ECU 40 and the COM 41 to perform as a device described in the specification and to perform steps of controlling method for the VVT described, in the specification. The COM 41 and peripheral devices provide the determining unit which determines stuck state of the restriction member. The stuck determination unit determines that whether or not the restricting condition or the enabling condition is satisfied or not. In addition, the stuck determination unit determines that whether or not the restriction mechanism provides the restricted state or the enabled state corresponding to the satisfied condition. The stuck determination unit determines that the restriction member is stuck in an abnormal state when the restricting condition or the enabling condition is satisfied and the restriction mechanism does not provide the restricted state or the enabled state corresponding to the satisfied condition.

In the following explanation, the abnormal states where the pin is stuck may also be referred to as the following abbreviated names:

LPF: Lock-pin-projected-stuck failure where the lock pin is stuck in the projected position;

LRF: Lock-pin-retracted-stuck failure where the lock pin is stuck in the retracted position;

RPF: Restriction-pin-projected-stuck failure where the restriction pin is stuck in the projected position; and RRF: Restriction-pin-retracted-stuck failure where the restriction pin is stuck in the retracted position.

Further, condition provided as an enabling condition and condition provided as a restricted condition may also be referred to as the following abbreviated names:

LPC: Lock-pin-projecting condition where the lock pin shall be projected;

LRC: Lock-pin-retracting condition where the lock pin shall be retracted;

RPC: Restriction-pin-projecting condition where the restriction pin shall be projected; and RRC: Restriction-pin-retracting condition where the restriction pin shall be retracted.

Figure 6:
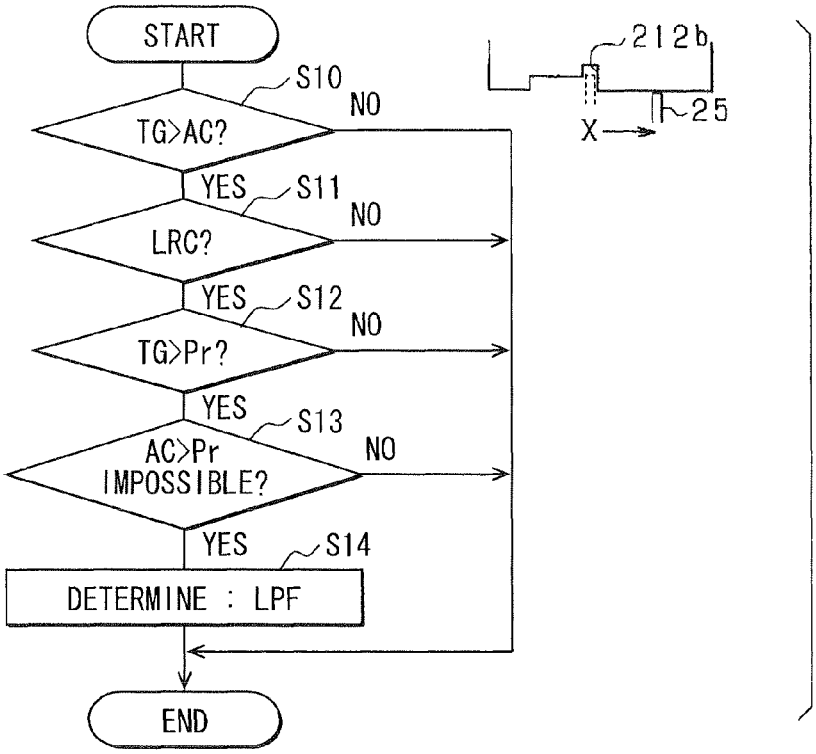
FIG. 6 is a flow chart showing determining process for a lock-pin-projected-stuck failure in the first embodiment.

FIG. 6 shows determining process for the LPF of the lock pin 25. The determining process causes the ECU 40 to provide means for determining the LPF. The process is designed to determine the LPF, if the LRC is satisfied and the relative rotation of the rotors 21 and 22 can not be changed from the inside to the outside of the first restricted range W1 defined by the guide slot 212. In other words, the process determines the LPF, if the VVT 20 can not be rotated to a region more advanced than the first restricted range W1, i.e., the lock position Pr defined by the advance-side wall 212*b* during the LRC is satisfied.

In a step S10, it is determined that whether it is required that the VVT 20 should be rotated in the advancing direction or not. That is, it is determined that whether the target position TG is in a region more advanced than the actual position AC or not. In a step S11, it is determined that whether the LRC is satisfied or not. In a step S12, it is determined that whether the target position TG is in a region more advanced than the restricting position Pr defined by the guide slot 212. In a step S13, it is determined that whether it is impossible to advance the VVT 20 beyond the position Pr. In other words, it is determined that whether the actual position AC can not be rotated to a region more advanced than the position Pr. For example, the step S13 is configured to make an affirmative determination when a condition where the target position TG is in a region more advanced than the actual position AC is maintained for a period equal to or longer than a predetermined time. Alternatively, the step S13 may be configured to make an affirmative determination when a condition where all determinations in the steps S10-S12 are affirmative is maintained for a period equal to or longer than a predetermined time. Therefore, the step S13 may be provided by a timer processing module which determines that at least one of affirmative determinations in the step S10 and S12 is continued for a predetermined time. If determinations in the steps S10-S13 are all affirmative, in a step S14, it is determined that the lock pin 25 is abnormally stuck in the projected position. The steps S10-S14 provide means for determining a lock-pin-projected-stuck failure.

Figure 7:
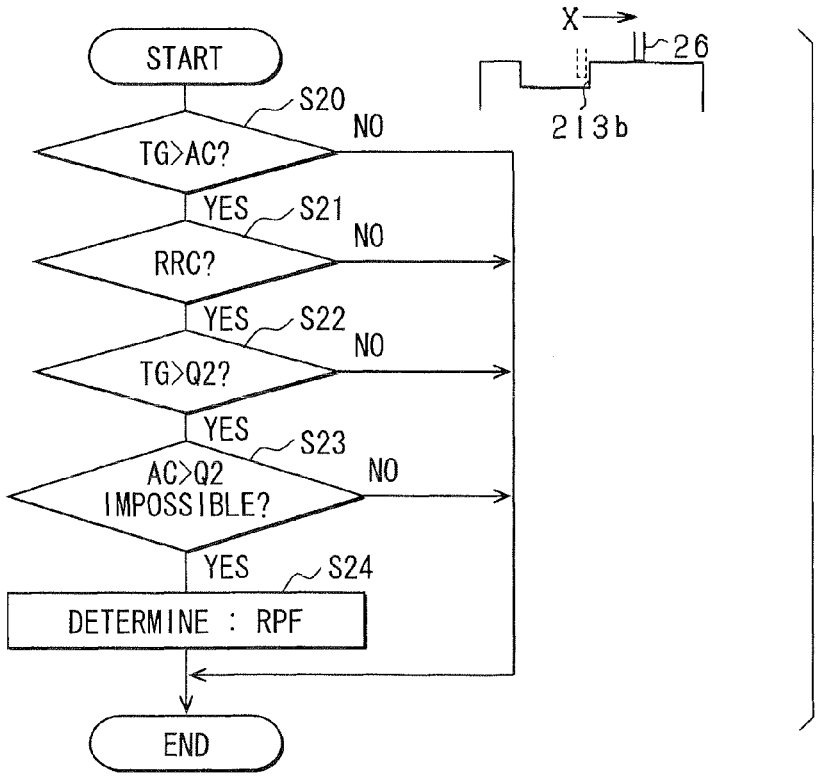
FIG. 7 is a flow chart showing determining process for a restriction-pin-projected-stuck failure in the first embodiment.

FIG. 7 shows determining process for the RPF of the restriction pin 26. The determining process causes the ECU 40 to provide means for determining the RPF. The process is designed to determine the RPF if the RRC is satisfied and the relative rotation of the rotors 21 and 22 can not be changed from the inside to the outside of the second restricted range W2 defined by the restriction slot 213. In other words, the process determines the RPF, if the VVT 20 can not be rotated to a region more advanced than the second restricted range W2, i.e., the position Q2 defined by the advance-side wall 213*b* during the RRC is satisfied.

In a step S20, it is determined that whether it is required that the VVT 20 should be rotated in the advancing direction or not. That is, it is determined that whether the target position TG is in a region more advanced than the actual position AC or not. In a step S21, it is determined that whether the RRC is satisfied or not. In a step S22, it is determined that whether the target position TG is in a region more advanced than the restricting position Q2 defined by the restriction slot 213. In a step S23, it is determined that whether it is impossible to advance the VVT 20 beyond the position Q2. In other words, it is determined that whether the actual position AC can not be rotated to a region more advanced than the position Q2. For example, the step S23 is configured to make an affirmative determination when a condition where the target position TG is in a region more advanced than the actual position AC is maintained for a period equal to or longer than a predetermined time. Alternatively, the step S23 may be configured to make an affirmative determination when a condition where all determinations in the steps S20-S22 are affirmative is maintained for a period equal to or longer than a predetermined time. If determinations in the steps S20-S23 are all affirmative, in a step S24, it is determined that the restriction pin 26 is abnormally stuck in the projected position. The steps S20-S24 provide means for determining a restriction-pin-projected-stuck failure.

Figure 8:
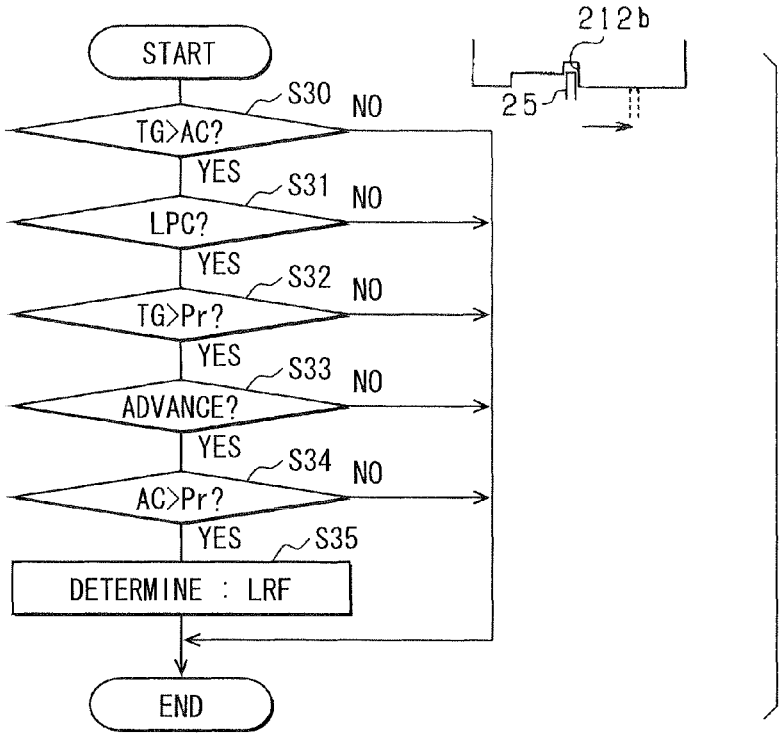
FIG. 8 is a flow chart showing determining process for a lock-pin-retracted-stuck failure in the first embodiment.

FIG. 8 shows determining process for the LRF of the lock pin 25. The determining process causes the ECU 40 to provide means for determining the LRF. The process is designed to determine the LRF, if the LPC is satisfied and the relative rotation of the rotors 21 and 22 is changed from the inside to the outside of the first restricted range W1 defined by the guide slot 212. In other words, the process determines the LRF if the VVT 20 is actually rotated to a region more advanced than the first restricted range W1, i.e., the lock position Pr defined by the advance-side wall 212*b* during the LPC is satisfied.

In a step S30, it is determined that whether it is required that the VVT 20 should be rotated in the advancing direction or not. That is, it is determined that whether the target position TG is in a region more advanced than the actual position AC or not. In a step S31, it is determined that whether the LPC is satisfied or not. In a step S32, it is determined that whether the target position TG is in a region more advanced than the restricting position Pr defined by the guide slot 212. In a step S33, it is determined that whether the VVT 20 starts rotation in the advancing direction. In a step S34, it is determined that whether the actual position AC is in a region more advanced than the first restricted range W1, i.e., the position Pr of an advance-side wall 212*b*, defined the guide slot 212. If determinations in the steps S30-S34 are all affirmative, in a step S35, it is determined that the lock pin 25 is abnormally stuck in the projected position. The steps S30-S35 provide means for determining a lock-pin-retracted-stuck failure.

Figure 9:
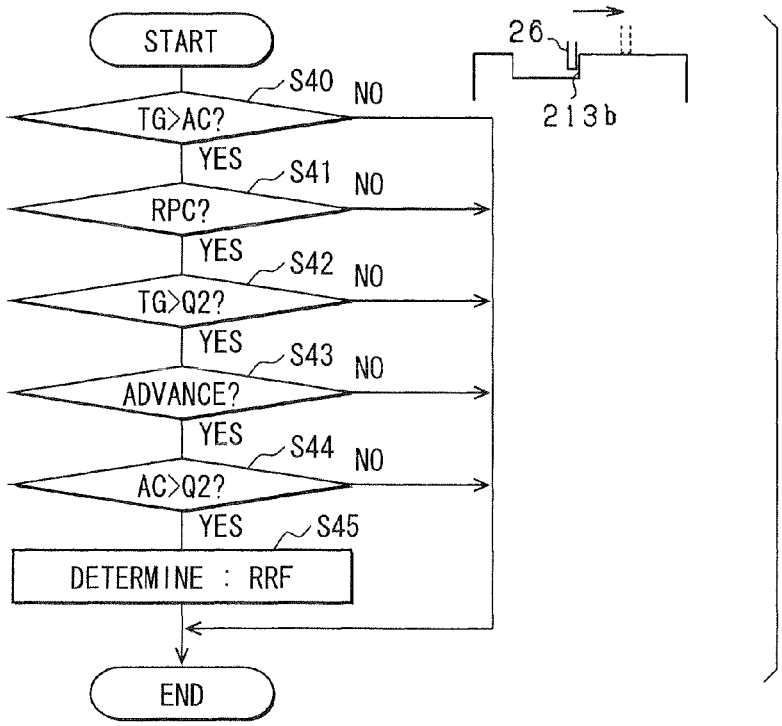
FIG. 9 is a flow chart showing determining process for a restriction-pin-retracted-stuck failure in the first embodiment.

FIG. 9 shows determining process for the RRF of the restriction pin 26. The determining process causes the ECU 40 to provide means for determining the RRF. The process is designed to determine the RRF, if the RPC is satisfied and the relative rotation of the rotors 21 and 22 is changed from the inside to the outside of the second restricted range W2 defined by the restriction slot 213. In other words, the process determines the RRF, if the VVT 20 is actually rotated to a region more advanced than the second restricted range W2, i.e., the position Q2 defined by the advance-side wall 213*b* during the RPC is satisfied.

In a step S40, it is determined that whether it is required that the VVT 20 should be rotated in the advancing direction or not. That is, it is determined that whether the target position TG is in a region more advanced than the actual position AC or not. In a step S41, it is determined that whether the RPC is satisfied or not. In a step S42, it is determined that whether the target position TG is in a region more advanced than the restricting position Q2 defined by the restriction slot 213. In a step S43, it is determined that whether the VVT 20 starts rotation in the advancing direction. In a step S44, it is determined that whether the actual position AC is in a region more advanced than the second restricted range W2, i.e., the position Q2 of an advance-side wall 213*b*, defined the restriction slot 213. If determinations in the steps S40-S44 are all affirmative, in a step S45, it is determined that the restriction pin 26 is abnormally stuck in the retracted position. The steps S40-S45 provide means for determining a restriction-pin-retracted-stuck failure.

Figure 10:
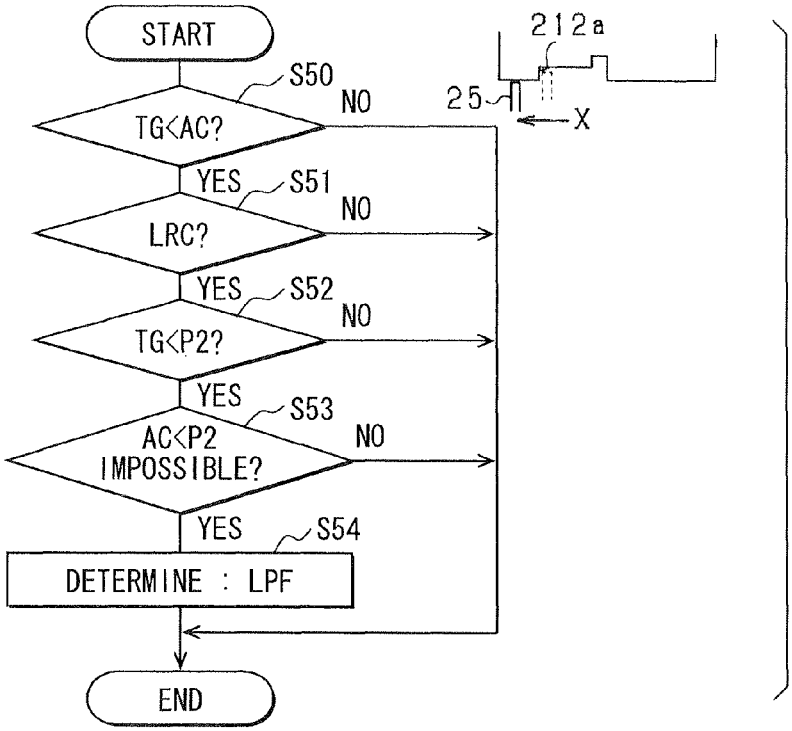
FIG. 10 is a flow chart showing first determining process for a lock-pin-projected-stuck failure in the first embodiment.

FIG. 10 shows determining process for the LPF of the lock pin 25. The determining process causes the ECU 40 to provide means for determining the LPF. The process is designed to determine the LPF if the LRC is satisfied and the relative rotation of the rotors 21 and 22 can not be changed from the inside to the outside of the first restricted range W1 defined by the guide slot 212. In other words, the process determines the LPF, if the VVT 20 can not be rotated to a region more retarded than the first restricted range W1, i.e., the position P2 defined by the retard-side wall 212*a* during the LRC is satisfied.

In a step S50, it is determined that whether it is required that the VVT 20 should be rotated in the retarding direction or not. That is, it is determined that whether the target position TG is in a region more retarded than the actual position AC or not. In a step S51, it is determined that whether the LRC is satisfied or not. In a step S52, it is determined that whether the target position TG is in a region more retarded than the restricting position P2 defined by the guide slot 212. In a step S53, it is determined that whether it is impossible to retard the VVT 20 beyond the position P2. In other words, it is determined that whether the actual position AC can not be rotated to a region more retarded than the position P2. For example, the step S53 is configured to make an affirmative determination when a condition where the target position TG is in a region more retarded than the actual position AC is maintained for a period equal to or longer than a predetermined time. Alternatively, the step S53 may be configured to make an affirmative determination when a condition where all determinations in the steps S50-S52 are affirmative is maintained for a period equal to or longer than a predetermined time. If determinations in the steps S50-S53 are all affirmative, in a step S54, it is determined that the lock pin 25 is abnormally stuck in the projected position. The steps S50-S54 provide means for determining a lock-pin-projected-stuck failure.

Figure 11:
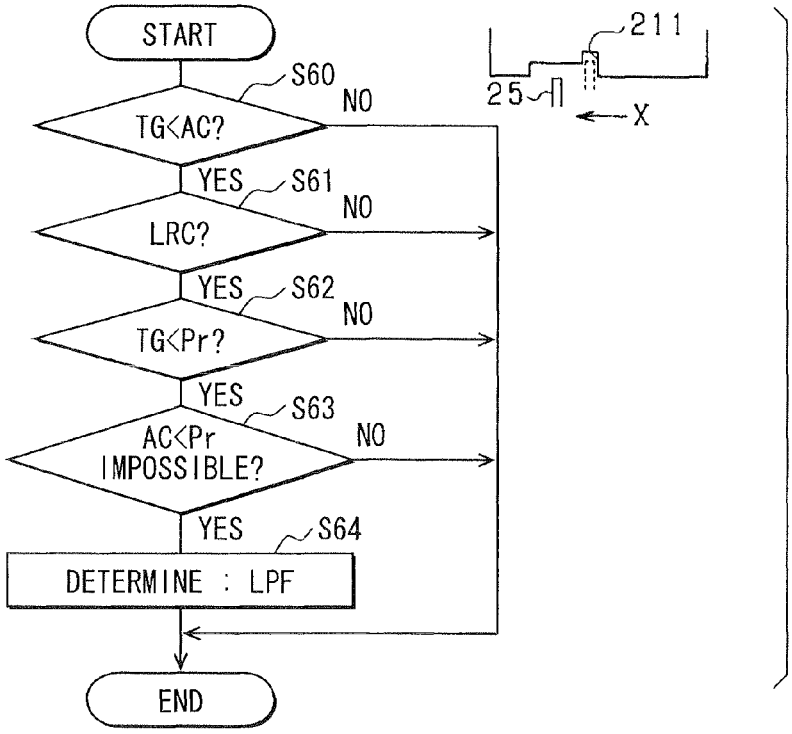
FIG. 11 is a flow chart showing second determining process for a lock-pin-projected-stuck failure in the first embodiment.

FIG. 11 shows determining process for the LPF of the lock pin 25. The determining process causes the ECU 40 to provide means for determining the LPF. The process is designed to determine the LPF, if the LRC is satisfied and the relative rotation of the rotors 21 and 22 can not be changed from the lock position Pr. In other words, the process determines the LPF, if the VVT 20 can not be rotated to a region more retarded than the lock position Pr during the LRC is satisfied.

In a step S60, it is determined that whether it is required that the VVT 20 should be rotated in the retarding direction or not. That is, it is determined that whether the target position TG is in a region more retarded than the actual position AC or not. In a step S61, it is determined that whether the LRC is satisfied or not. In a step S62, it is determined that whether the target position TG is in a region more retarded than the lock position Pr. In a step S63, it is determined that whether it is impossible to retard the VVT 20 beyond the lock position Pr. In other words, it is determined that whether the actual position AC can not be rotated to a region more retarded than the lock position Pr. For example, the step S63 is configured to make an affirmative determination when a condition where the target position TG is in the lock position Pr is maintained for a period equal to or longer than a predetermined time. Alternatively, the step S63 may be configured to make an affirmative determination when a condition where all determinations in the steps S60-S62 are affirmative is maintained for a period equal to or longer than a predetermined time. If determinations in the steps S60-S63 are all affirmative, in a step S64, it is determined that the lock pin 25 is abnormally stuck in the projected position. The steps S60-S64 provide means for determining a lock-pin-projected-stuck failure.

Figure 12:
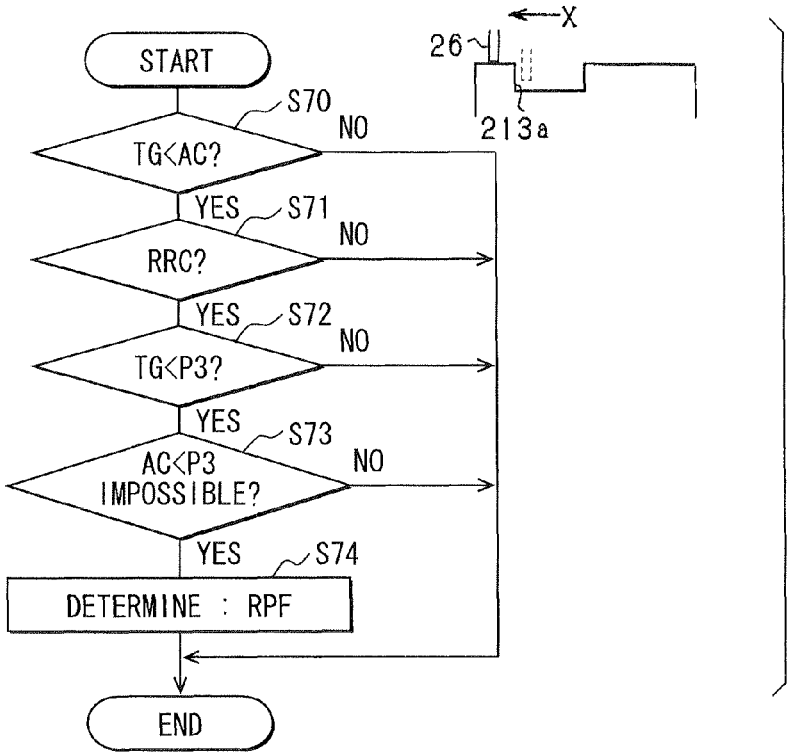
FIG. 12 is a flow chart showing determining process for a restriction-pin-projected-stuck failure in the first embodiment.

FIG. 12 shows determining process for the RPF of the restriction pin 26. The determining process causes the ECU 40 to provide means for determining the RPF. The process is designed to determine the RPF, if the RRC is satisfied and the relative rotation of the rotors 21 and 22 can not be changed from the inside to the outside of the second restricted range W2 defined by the restriction slot 213. In other words, the process determines the RPF, if the VVT 20 can not be rotated to a region more retarded than the second restricted range W2, i.e., the position P3 defined by the retard-side wall 213*a* during the RRC is satisfied.

In a step S70, it is determined that whether it is required that the VVT 20 should be rotated in the retarding direction or not. That is, it is determined that whether the target position TG is in a region more retarded than the actual position AC or not. In a step S71, it is determined that whether the RRC is satisfied or not. In a step S72, it is determined that whether the target position TG is in a region more retarded than the restricting position P3 defined by the guide slot 212. In a step S73, it is determined that whether it is impossible to retard the VVT 20 beyond the position P3. In other words, it is determined that whether the actual position AC can not be rotated to a region more retarded than the position P3. For example, the step S73 is configured to make an affirmative determination when a condition where the target position TG is in a region more retarded than the actual position AC is maintained for a period equal to or longer than a predetermined time. Alternatively, the step S73 may be configured to make an affirmative determination when a condition where all determinations in the steps S70-S72 are affirmative is maintained for a period equal to or longer than a predetermined time. If determinations in the steps S70-S73 are all affirmative, in a step S74, it is determined that the restriction pin 26 is abnormally stuck in the projected position. The steps S70-S74 provide means for determining a restriction-pin-projected-stuck failure.

Figure 13:
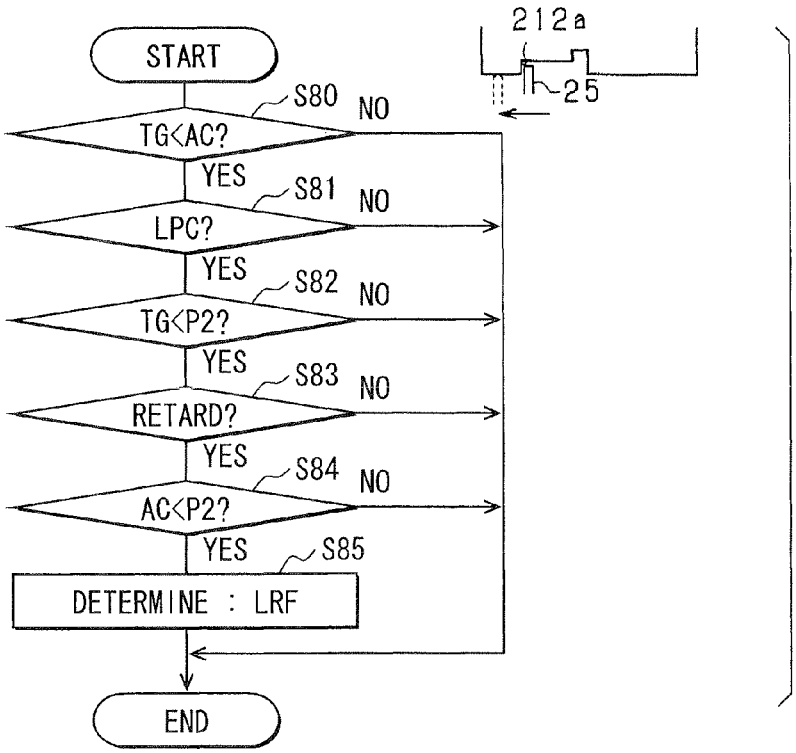
FIG. 13 is a flow chart showing determining process for a lock-pin-retracted-stuck failure in the first embodiment.

FIG. 13 shows determining process for the LRF of the lock pin 25. The determining process causes the ECU 40 to provide means for determining the LRF. The process is designed to determine the LRF, if the LPC is satisfied and the relative rotation of the rotors 21 and 22 is actually changed from the inside to the outside of the first restricted range W1 defined by the guide slot 212. In other words, the process determines the LRF, if the VVT 20 is actually rotated to a region more retarded than the first restricted range W1, i.e., the position P2 defined by the retard-side wall 212*a* during the LPC is satisfied.

In a step S80, it is determined that whether it is required that the VVT 20 should be rotated in the retarding direction or not. That is, it is determined that whether the target position TG is in a region more retarded than the actual position AC or not. In a step S81, it is determined that whether the LPC is satisfied or not. In a step S82, it is determined that whether the target position TG is in a region more retarded than the restriction position P2 defined by the guide slot 212. In a step S83, it is determined that whether the VVT 20 starts rotation in the retarding direction. In a step S84, it is determined that whether the actual position AC is in a region more retarded than the restriction position P2 defined by the guide slot 212. If determinations in the steps S80-S84 are all affirmative, in a step S85, it is determined that the lock pin 25 is abnormally stuck in the retracted position. The steps S80-S85 provide means for determining a lock-pin-retracted-stuck failure.

Figure 14:
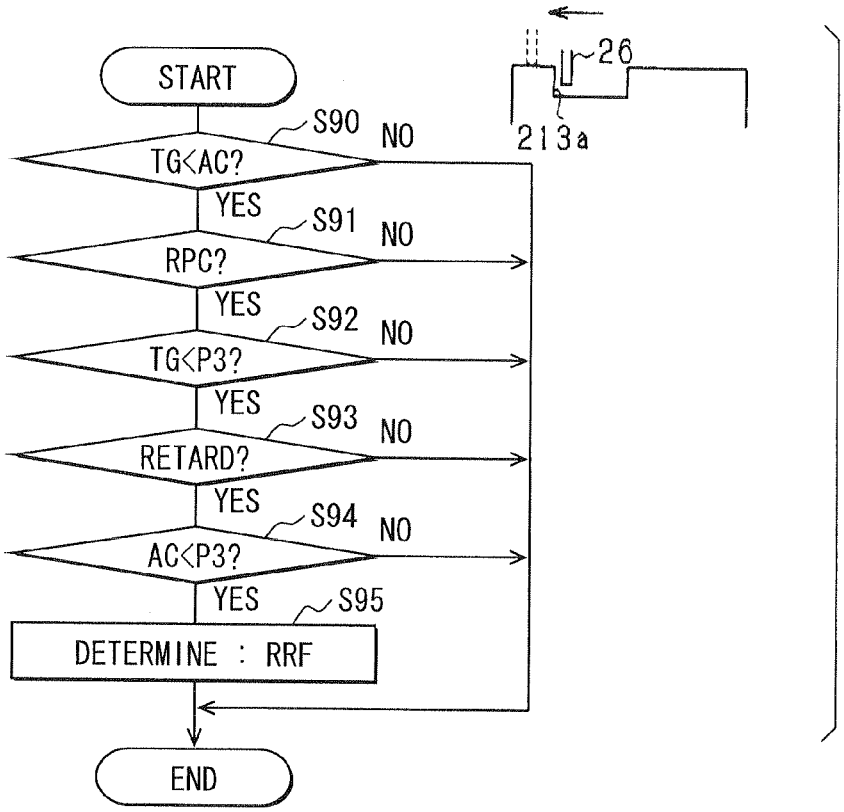
FIG. 14 is a flow chart showing determining process for a restriction-pin-retracted-stuck failure in the first embodiment.

FIG. 14 shows determining process for the RRF of the restriction pin 26. The determining process causes the ECU 40 to provide means for determining the RRF. The process is designed to determine the RRF, if the RPC is satisfied and the relative rotation of the rotors 21 and 22 is changed from the inside to the outside of the second restricted range W2 defined by the restriction slot 213. In other words, the process determines the RRF, if the VVT 20 is actually rotated to a region more retarded than the second restricted range W2, i.e., the position P3 defined by the retard-side wall 213*a* during the RPC is satisfied.

In a step S90, it is determined that whether it is required that the VVT 20 should be rotated in the retarding direction or not. That is, it is determined that whether the target position TG is in a region more retarded than the actual position AC or not. In a step S91, it is determined that whether the RPC is satisfied or not. In a step S92, it is determined that whether the target position TG is in a region more retarded than the restricting position P3 defined by the restriction slot 213. In a step S93, it is determined that whether the VVT 20 starts rotation in the retarding direction. In a step S94, it is determined that whether the actual position AC is in a region more retarded than the restriction position P3 defined by the restriction slot 213. If determinations in the steps S90-S94 are all affirmative, in a step S95, it is determined that the restriction pin 26 is abnormally stuck in the retracted position. The steps S90-S95 provide means for determining a restriction-pin-retracted-stuck failure.

Further, the ECU 40 provides a module which collects determined results in the above-mentioned process, and selects appropriate controls for the VVT 20 based on the determined results. If the step S13 in FIG. 6, the step S34 in FIG. 8, the step S53 in FIG. 10, the step S63 in FIG. 11, and the step S84 in FIG. 13 all make negative determinations, then, the COM 41 determines that the lock pin 25 has no stuck failure and can work properly. If the step S23 in FIG. 7, the step S44 in FIG. 9, the step S73 in FIG. 12, and the step S94 in FIG. 14 all make negative determinations, then, the COM 41 determines that the restriction pin 26 has no stuck failure and can work properly. The ECU 40 performs normal control for the VVT 20 when both the lock pin 25 and the restriction pin 26 have no stuck failure. If at least one of the failures is determined, the ECU 40 performs fail safe control corresponding to the determined failure.

According to the embodiment, the ECU 40 determines that whether or not behavior or relative rotational states of the VVT 20 is in condition which can be realized only in stuck failure of the pin 25 or 26. Therefore, it is possible to make a reliable determination of stuck failure of the pin 25 or 26.

Second Embodiment

A VVT in this embodiment does not have the restriction pin 26 and the restriction slot 213 in the above-mentioned first embodiment. Other mechanical configurations are the same as the first embodiment. The COM 41 performs process shown in FIGS. 15 and 16 to determine that whether the lock pin 25 is stuck or not.

Figure 15:
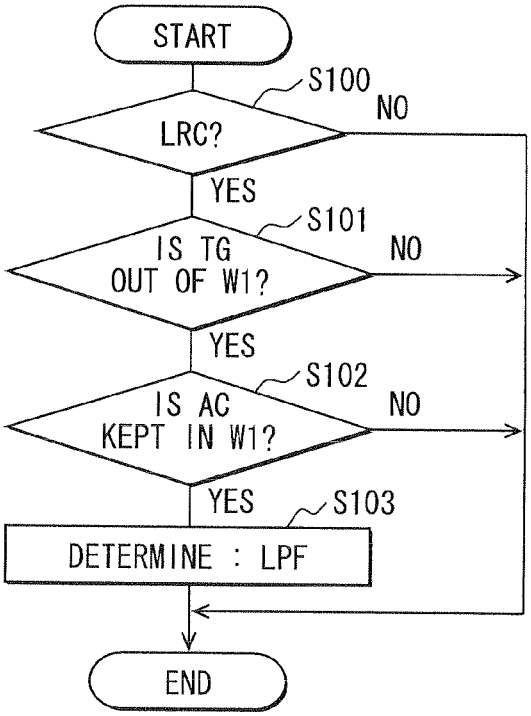
FIG. 15 is a flow chart showing determining process for a lock-pin-projected-stuck failure according to a second embodiment of the present invention.

FIG. 15 shows determining process for the LPF of the lock pin 25. The determining process causes the ECU 40 to provide means for determining the LPF. The process is designed to determine the LPF, if the LRC is satisfied and the relative rotation of the rotors 21 and 22 can not be changed from the inside to the outside of the first restricted range W1 defined by the guide slot 212. In other words, the process determines the LPF, if the VVT 20 can not be rotated to an outside region from the first restricted range W1 during the LRC is satisfied.

In a step S100, it is determined that whether the LRC is satisfied or not. In a step S101, it is determined that whether the target position TG is changed from the inside to the outside of the first restricted range W1 or not. In a step S102, it is determined that whether it is impossible to rotate the VVT 20 to the outside of the first restricted range W1 or not. In other words, it is determined that whether the actual position AC is maintained within the first restricted range W1 or not. For example, the step S102 is configured to make an affirmative determination when a condition where the actual position AC is in the first restricted range W1 is maintained for a period equal to or longer than a predetermined time. Alternatively, the step S102 may be configured to make an affirmative determination when a condition where all determinations in the steps S100-S101 are affirmative is maintained for a period equal to or longer than a predetermined time. If determinations in the steps S100-S102 are all affirmative, in a step S103, it is determined that the lock pin 25 is abnormally stuck in the projected position. The steps S100-S103 provide means for determining a lock-pin-projected-stuck failure.

Figure 16:
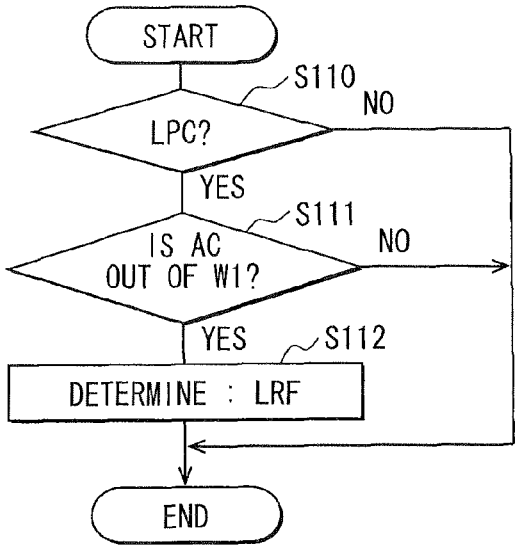
FIG. 16 is a flow chart showing determining process for a lock-pin-retracted-stuck failure in the second embodiment.

FIG. 16 shows determining process for the LRF of the lock pin 25. The determining process causes the ECU 40 to provide means for determining the LRF. The process is designed to determine the LRF, if the LPC is satisfied and the relative rotation of the rotors 21 and 22 is changed from the inside to the outside of the first restricted range W1 defined by the guide slot 212. In other words, the process determines the LRF if the VVT 20 is actually rotated to a region outside the first restricted range W1 during the LPC is satisfied.

In a step S110, it is determined that whether the LPC is satisfied or not. In a step S111, it is determined that whether the actual position AC is changed from the inside to the outside of the first restricted range W1 or not. If determinations in the steps S110-S111 are all affirmative, in a step S112, it is determined that the lock pin 25 is abnormally stuck in the retracted position. The steps S110-S112 provide means for determining a lock-pin-retracted-stuck failure.

According to the embodiment, the ECU 40 determines that whether or not behavior or relative rotational states of the VVT 20 is in condition which can be realized only in stuck failure of the pin 25. Therefore, it is possible to make a reliable determination of stuck failure of the pin 25.

Third Embodiment

Figure 17:
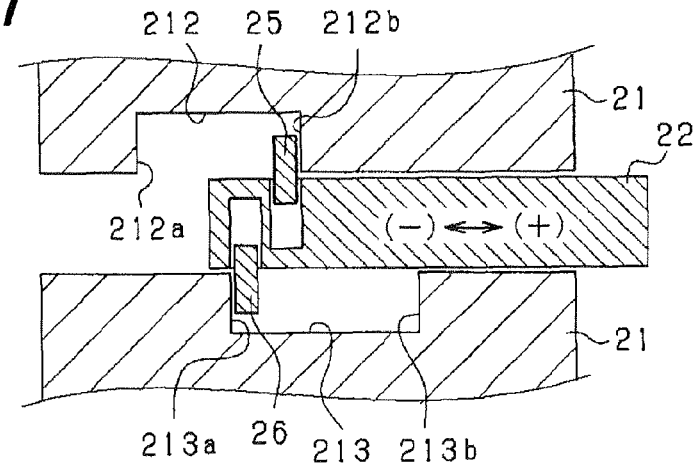
FIG. 17 is a schematic sectional view showing an engaged state of a lock pin and a lock slot according to a third embodiment of the present invention.
Figure 18:
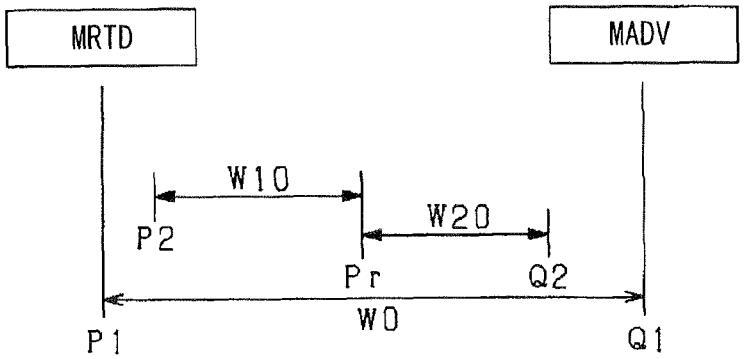
FIG. 18 is a graph showing a first restricted range and a second restricted range in the third embodiment.

As shown in FIG. 17, a VVT in a third embodiment does not include the lock slot 211 in the first embodiment. As shown in FIG. 18, the VVT provides a first restricted range W10 provided by the first restriction slot 212 and a second restricted range (additional restricted range) W20 provided by the second restriction slot 213. The ranges W10 and W20 are arranged as shown in FIG. 18. Other configurations are the same as the first embodiment.

In this embodiment, the VVT includes a first restriction pin 25 and a second restriction pin 26 provided on the second rotor 22. The pins 25 and 26 are projected from the second rotor 22 to the projected position when a restriction-pin-projecting condition provided as the restricting condition is satisfied. The pins 25 and 26 are retracted into the second rotor 22 to the retracted position when a restriction-pin-retracting condition provided as the enabling condition is satisfied. The VVT includes a first restriction slot 212 provided on the first rotor 21. The first restriction slot 212 restricts rotatable range of the first restriction pin 25 in the projected position within a first restricted range W10. The VVT further includes a second restriction slot 213 provided on the first rotor 21. The second restriction slot 213 restricts rotatable range of the second restriction pin 26 in the projected position within a second restricted range W20. The first and second restricted ranges W10 and W20 are set to lock the rotors to be impossible to rotate relatively by simultaneously restricting the first restriction pin 25 in the first restricted range W10 and the second restriction pin 26 in the second restricted range W20.

The first restricted range W10 and the second restricted range W20 overlaps only at the lock position Pr. The first restricted range W10 and the second restricted range W20 are defined as substantially different ranges. The first restriction slot 212 has an advance-side wall 212*b* which can restrict advancing movement of the first restriction pin 25 in the projected position. The second restriction slot 213 has a retard-side wail 213*a* which can restrict retarding movement of the second restriction pin 26 in the projected position. The restricted ranges W10 and W20 are set to provide the above-mentioned restricted states simultaneously. Since the first restriction slot 212 restricts the advancing movement of the first restriction pin 25, and, at the same time, the second restriction slot 213 restricts the retarding movement of the second restriction pin 26, the rotors 25 and 26 are locked at the lock position Pr. Thereby, it is possible to lock the rotors 21 and 22 without the lock slot 211. The first restriction slot 212 corresponds to the guide slot 212 in the first embodiment. The second restriction slot 213 corresponds to the restriction slot 213 in the first embodiment. The first restriction pin 25 corresponds to the lock pin 25 in the first embodiment. The second restriction pin 26 corresponds to the restriction pin 26 in the first embodiment.

In this embodiment, the same process as shown in FIGS. 6-10 and 12-14 is performed. Therefore, the ECU 40 determines that whether or not behavior or relative rotational phase states of the VVT 20 is in condition which can be realized only in stuck failure of the pin 25 or 26. Therefore, it is possible to determine an existence or absence of stuck failure of either one of the restriction pins 25 and 26.

Other Embodiments

Although the present invention has been fully described in connection with the preferred embodiments thereof with reference to the accompanying drawings, it is to be noted that various changes and modifications will become apparent to those skilled in the art. For example, the components described in the preceding embodiments can be interchanged or combined. Such changes and modifications are to be understood as being within the scope of the present invention as defined by the appended claims.

For example, although the lock slot 211 is located in the advance-side end of the guide slot 212 in the first and second embodiments, the lock slot 211 may be located in the retard-side end of the guide slot 212.

Although the stuck failure of the lock pin 25 and the stuck failure of the restriction pin 26 are separately determined in the first embodiment, the stuck failure may be determined by the following configurations. For example, the stuck determination unit may include a consolidated-retracted-stuck-determination unit which determines that at least one of the lock pin 25 and the restriction pin 26 is stuck in the retracted position when both the lock-pin-projecting condition and the restriction-pin-projecting condition are satisfied and the relative rotational position of the VVT 20 is changed from an inside to an outside of a consolidated range. The consolidated range includes both the first restricted range W1 and the second restricted range W2. However, this method can not determine which pin is stuck in the retracted position.

For example, the stuck determination unit may include a consolidated-projected-stuck-determination unit which determines that at least one of the lock pin 25 and the restriction pin 26 is stuck in the projected position when both the lock-pin-retracting condition and the restriction-pin-retracting condition are satisfied and the relative rotational position of the VVT 20 can not be changed from the inside to the outside of the consolidated range. However, this method can not determine which pin is stuck in the projected position.

Further, the above-mentioned consolidated determination method can be applied to the configuration in the third embodiment. For example, the stuck determination unit may include a consolidated-retracted-stuck-determination unit which determines that at least one of the lock pin 25 and the restriction pin 26 is stuck in the retracted position when both the lock-pin-projecting condition and the restriction-pin-projecting condition are satisfied and the relative rotational position of the VVT 20 is changed from an inside to an outside of a consolidated range. The consolidated range includes both the first restricted range W10 and the second restricted range W20. For example, the stuck determination unit may include a consolidated-projected-stuck-determination unit which determines that at least one of the lock pin 25 and the restriction pin 26 is stuck in the projected position when both the lock-pin-retracting condition and the restriction-pin-retracting condition are satisfied and the relative rotational position of the VVT 20 can not be changed from the inside to the outside of the consolidated range. However, this method can not determine which pin is stuck.

In the step S13 in FIG. 6 and the step S53 in FIG. 10, the determination unit may be configured to determine that whether the relative rotational position can not be advanced or retarded to the outside of the first restricted range W1 from a region which is located on an outside of the second restricted range W2 and is located on an inside of the first restricted range W1. According to the above-mentioned configuration, it is possible to determine the projected stuck failure of the lock pin 25 while eliminating a state where the restriction pin 26 is in the projected stuck failure and the VVT 20 is adversely restricted by the restriction slot 213 despite satisfying the retracting condition.

In the step S23 in FIG. 7 and the step S73 in FIG. 12, the determination unit may be configured to determine that whether the relative rotational position can not be advanced or retarded to the outside of the second restricted range W2 from a region which is located on an outside of the first restricted range W1 and is located on an inside of the second restricted range W2. According to the above-mentioned configuration, it is possible to determine the projected stuck failure of the restriction pin 26 while eliminating a state where the lock pin 25 is in the projected stuck failure and the VVT 20 is adversely restricted by the guide slot 212 despite satisfying the retracting condition.

In the step S34 in FIG. 8 and the step S84 in FIG. 13, the determination unit may be configured to determine that whether the relative rotational position is advanced or retarded to the outside of the first restricted range W1 from a region which is located on an outside of the second restricted range W2 and is located on an inside of the first restricted range W1. According to the above-mentioned configuration, it is possible to determine the retracted stuck failure of the lock pin 25 while eliminating a state where the restriction pin 26 is in the retracted stuck failure and the VVT 20 is not adversely restricted by the restriction slot 213 despite satisfying the projecting condition.

In the step S44 in FIG. 9 and the step S94 in FIG. 14, the determination unit may be configured to determine that whether the relative rotational position is advanced or retarded to the outside of the second restricted range W2 from a region which is located on an outside of the first restricted range W1 and is located on an inside of the second restricted range W2. According to the above-mentioned configuration, it is possible to determine the retracted stuck failure of the restriction pin 26 while eliminating a state where the lock pin 25 is in the projected stuck failure and the VVT 20 is not adversely restricted by the guide slot 212 despite satisfying the projecting condition.

The components and modules in the above embodiments may be provided by software, hardware or combination of them.

What is claimed is:

1. A variable valve timing device which varies valve timing by changing relative rotational phase between a camshaft for operating an intake valve or an exhaust valve and an output shaft of an engine, the device comprising:

a first rotor which rotates with either one of the camshaft and the output shaft;

a second rotor which rotates with the other one of the camshaft and the output shaft;

a rotating mechanism which adjusts the valve timing of the intake valve or the exhaust valve by relatively rotating the rotors;

a restriction mechanism which selectively provides a restricted state in which relative rotation of the rotors is restricted in a predetermined restricted range and an enabled state in which relative rotation of the rotors is enabled to an outside of the restricted range, the restriction mechanism including a movable restriction member which provides the restricted state by being moved to a restricting position when a predetermined restricting condition is satisfied, and the enabled state by being moved to an enabling position when a predetermined enabling condition is satisfied; and a stuck determination unit which determines that the restriction member is stuck in an abnormal state when the restricting condition or the enabling condition is satisfied and the restriction mechanism does not provide the restricted state or the enabled state corresponding to the satisfied condition, wherein the restriction mechanism includes:

a pin provided as the restriction member, the pin being projected at a projected position provided as the restricting position, and being retracted at a retracted position provided as the enabling position, and a slot which provides the restricted state by being engaged with the pin which is in the projected position, and provides the enabled state by being disengaged with the pin which is in the retracted position, the stuck determination unit includes a retracted stuck determination unit which determines that the restriction member is stuck in the retracted position when the restricting condition is satisfied and the restriction mechanism does not provide the restricted state.

2. A variable valve timing device which varies valve timing by changing relative rotational phase between a camshaft for operating an intake valve or an exhaust valve and an output shall of an engine, the device comprising:

a first rotor which rotates with either one of the camshaft and the output shaft;

a second rotor which rotates with the other one of the camshaft and the output shaft;

a rotating mechanism which adjusts the valve timing of the intake valve or the exhaust valve by relatively rotating the rotors;

a restriction mechanism which selectively provides a restricted state in which relative rotation of the rotors is restricted in a predetermined restricted range and an enabled state in which relative rotation of the rotors is enabled to an outside of the restricted range, the restriction mechanism including a movable restriction member which provides the restricted state by being moved to a restricting position when a predetermined restricting condition is satisfied and the enabled state by being moved to an enabling position when a predetermined enabling condition is satisfied; and a stuck determination unit which determines that the restriction member is stuck in an abnormal state when the restricting condition or the enabling condition is satisfied and the restriction mechanism does not provide the restricted state or the enabled state corresponding to the satisfied condition, wherein the restriction mechanism includes:

the pin provided as the restriction member, the pin being projected at a projected position provided as the restricting position, and being retracted at a retracted position provided as the enabling position, and a slot which provides the restricted state by being engaged with the pin which is in the projected position, and provides the enabled state by being disengaged with the pin which is in the retracted position, wherein the pin includes:

a lock pin provided on the second rotor, the lock pin being projected from the second rotor to the projected position when a lock-pin-projecting condition provided as the restricting condition is satisfied, and being retracted into the second rotor to the retracted position when a lock-pin-retracting condition provided as the enabling condition is satisfied, and the slot includes:

a lock slot provided on the first rotor, the lock slot being engaged with the lock pin in the projected position to lock the rotors to be impossible to rotate relatively, and a guide slot provided on the first rotor, the guide slot restricting rotatable range of the lock pin in the projected position to restrict the relative rotation of the rotors within the restricted range and to facilitate an engagement between the lock pin and the lock slot, the stuck determination unit includes a lock-pin-retracted-stuck-determination unit which determines that the lock pin is stuck in the retracted position when the lock-pin-projecting condition is satisfied and the relative rotation of the rotors is changed from an inside to an outside of the restricted range.

3. The variable valve timing device in claim 2, wherein the stuck determination unit further includes a lock-pin-projected-stuck-determination unit which determines that the lock pin is stuck in the projected position when the lock-pin-retracting condition is satisfied and the relative rotation of the rotors can not be changed from the inside to the outside of the restricted range.

4. A variable valve timing device which varies valve timing by changing relative rotational phase between a camshaft for operating an intake valve or an exhaust valve and an output shaft of an engine, the device comprising:

a first rotor which rotates with either one of the camshaft and the output shaft;

a second rotor which rotates with the other one of the camshaft and the output shaft;

a rotating mechanism which adjusts the valve timing of the intake valve or the exhaust valve by relatively rotating the rotors;

restriction mechanism which selectively provides a restricted state in which relative rotation of the rotors is restricted in a predetermined restricted range and an enabled state in which relative rotation of the rotors is enabled to an outside of the restricted range, the restriction mechanism including a movable restriction member which provides the restricted state by being moved to a restricting position when a predetermined restricting condition is satisfied, and the enabled state by being moved to an enabling position when a predetermined enabling condition is satisfied; and a stuck determination unit which determines that the restriction member is stuck in an abnormal state when the restricting condition or the enabling condition is satisfied and the restriction mechanism does not provide the restricted state or the enabled state corresponding to the satisfied condition, wherein the restriction mechanism includes:

a pin provided as the restriction member, the pin being projected at a projected position provided as the restricting position, and being retracted at a retracted position provided as the enabling position, and a slot which provides the restricted state by being engaged with the pin which is in the projected position, and provides the enabled state by being disengaged with the pin which is in the retracted position, the pin includes:

a lock pin provided on the second rotor, the lock pin being projected from the second rotor to the projected position when a lock-pin-projecting condition provided as the restricting condition is satisfied, and being retracted into the second rotor to the retracted position when a lock-pin-retracting condition provided as the enabling condition is satisfied, and the slot includes:

a lock slot provided on the first rotor, the lock slot being engaged with the lock pin in the projected position to lock the rotors to be impossible to rotate relatively, and a guide slot provided on the first rotor, the guide slot restricting rotatable range of the lock pin in the projected position to restrict the relative rotation of the rotors within the restricted range and to facilitate an engagement between the lock pin and the lock slot, the restriction mechanism further includes:

a restriction pin provided on the second rotor, the restriction pin being projected from the second rotor to the projected position when a restriction-pin-projecting condition provided as the restricting condition is satisfied, and being retracted into the second rotor to the retracted position when a restriction-pin-retracting condition provided as the enabling condition is satisfied, and a restriction slot provided on the first rotor, the restriction slot restricting rotatable range of the restriction pin in the projected position within an additional restricted range which is set to be different from the restricted range provided by the lock pin and the guide slot and to be overlapped with a lock position provided by the lock pin and the lock slot, the stuck determination unit includes:

a restriction-pin-projected-stuck-determination unit which determines that the restriction pin is stack in the projected position when the restriction-pin-retracting condition is satisfied and the relative rotation of the rotors can not be changed from an inside to an outside of the additional restricted range, the stuck determination unit further includes a restriction-pin-retracted-stuck-determination unit which determines that the restriction pin is stuck in the retracted position when the restriction-pin-projecting condition is satisfied and the relative rotation of the rotors is changed from the inside to the outside of the additional restricted range.

5. A variable valve timing device which varies valve timing by changing relative rotational phase between a camshaft for operating an intake valve or an exhaust valve and an output shall of an engine, the device comprising:

a first rotor which rotates with either one of the camshaft and the output shaft;

a second rotor which rotates with the other one of the camshaft and the output shaft;

a rotating mechanism which adjusts the valve timing of the intake valve or the exhaust valve by relatively rotating the rotors;

a restriction mechanism which selective provides a restricted state in which relative rotation of the rotors is restricted in a predetermined restricted range and an enabled state in which relative rotation of the rotors is enabled to an outside of the restricted range, the restriction mechanism including a movable restriction member which provides the restricted state by being moved to a restricting position when a predetermined restricting condition is satisfied, and the enabled state by being moved to an enabling position when a predetermined enabling condition is satisfied; and a stuck determination unit which determines that the restriction member is stuck in an abnormal state when the restricting condition or the enabling condition is satisfied and the restriction mechanism does not provide the restricted state or the enabled state corresponding to the satisfied condition, wherein the restriction mechanism includes:

a pin provided as the restriction member, the pin being projected at a projected position provided as the restricting position, and being retracted at a retracted position provided as the enabling position, and a slot which provides the restricted state by being engaged with the in which is in the projected position, and provides the enabled state by being disengaged with the pin which is in the retracted position, the pin includes:

a lock pin provided on the second rotor, the lock pin being projected from the second rotor to the projected position when a lock-pin-projecting condition provided as the restricting condition is satisfied and being retracted into the second rotor to the retracted position when a lock-pin-retracting condition provided as the enabling condition is satisfied, and the slot includes:

a lock slot provided on the first rotor, the lock slot being engaged with the lock pin in the projected position to lock the rotors to be impossible to rotate relatively, and a guide slot provided on the first rotor, the guide slot restricting rotatable range of the lock pin in the projected position to restrict the relative rotation of the rotors within the restricted range and to facilitate an engagement between the lock pin and the lock slot, the restriction mechanism further includes:

a restriction pin provided on the second rotor, the restriction pin being projected from the second rotor to the projected position when a restriction-pin-projecting condition provided as the restricting condition is satisfied, and being retracted into the second rotor to the retracted position when a restriction-pin-retracting condition provided as the enabling condition is satisfied, and a restriction slot provided on the first rotor, the restriction slot restricting rotatable range of the restriction pin in the projected position within an additional restricted range which is set to be different from the restricted range provided by the lock pin and the guide slot and to be overlapped with a lock position provided by the lock pin and the lock slot, the stuck determination unit includes a restriction-pin-retracted-stuck-determination unit which determines that the restriction pin is stuck in the retracted position when the restriction-pin-projecting condition is satisfied and the relative rotation of the rotors is changed from an inside to an outside of the additional restricted range.

* * * * *